US009709961B2

(12) United States Patent
Fujisawa

(10) Patent No.: US 9,709,961 B2
(45) Date of Patent: Jul. 18, 2017

(54) RADIO CONTROLLED TIMEPIECE AND METHOD FOR CONTROLLING RADIO CONTROLLED TIMEPIECE

(71) Applicant: SEIKO EPSON CORPORATION, Tokyo (JP)

(72) Inventor: Teruhiko Fujisawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/947,258

(22) Filed: Nov. 20, 2015

(65) Prior Publication Data

US 2016/0259303 A1 Sep. 8, 2016

(30) Foreign Application Priority Data

Mar. 4, 2015 (JP) ..... 2015-041995

(51) Int. Cl.
*G04R 20/08* (2013.01)
*G04R 20/00* (2013.01)
*G04R 20/10* (2013.01)

(52) U.S. Cl.
CPC ..... *G04R 20/00* (2013.01); *G04R 20/08* (2013.01); *G04R 20/10* (2013.01)

(58) Field of Classification Search
CPC ..... G04R 20/08–20/10
See application file for complete search history.

(56) References Cited

U.S. PATENT DOCUMENTS 5,528,560 A * 6/1996 Ogiyama ..... G04G 3/022 368/47
7,031,696 B2 * 4/2006 Gerrits ..... G04R 20/22 368/47
2005/0036514 A1 * 2/2005 Polonio ..... H04L 25/4902 370/470
2007/0230285 A1 * 10/2007 Nakagawa ..... G01S 19/14 368/47
2007/0300065 A1 * 12/2007 Akiyama ..... G06F 1/14 713/168
2009/0015470 A1 * 1/2009 Fujisawa ..... G01S 19/235 342/357.62
2010/0214165 A1 * 8/2010 Baba ..... G01S 19/19 342/357.25

FOREIGN PATENT DOCUMENTS

JP 2002-181963 A 6/2002
JP 2005-233825 A 9/2005
JP 2006-349445 A 12/2006

* cited by examiner

*Primary Examiner* — Amy Cohen Johnson
*Assistant Examiner* — Jason Collins
(74) *Attorney, Agent, or Firm* — Global IP Counselors, LLP

(57) ABSTRACT

The fixed-time reception control section carries out the reception process at first time to acquire first reception time data and compares the acquired first reception time data with the internal time. When a difference in time between the first reception time data and the internal time is greater than or equal to a first threshold, the fixed-time reception control section carries out the reception process at second time different from the first time to acquire second reception time data. The time correction section compares the acquired second reception time data with the internal time and corrects the internal time based on the second reception time data when a difference in time between the second reception time data and the internal time is smaller than a second threshold.

9 Claims, 18 Drawing Sheets

| CASE | FIRST RECEPTION TIME DATA | SECOND RECEPTION TIME DATA | CORRECTED TIME |
|---|---|---|---|
| 1 | A1 | NO FIXED-TIME RECEPTION | A1 |
| 2 | B1 | A2 | A2 |
| 3 | B1 | B2 (WHICH CONFORMS WITH B1) | B2 |
| 4 | B1 | B3 (WHICH DOES NOT CONFORM WITH B1) | NO CORRECTION |

※ A1 AND A2 ARE TIMES THAT DIFFER FROM INTERNAL TIME BY PERIOD SMALLER THAN 15 SECONDS
B1, B2 AND B3 ARE TIMES THAT DIFFER FROM THE INTERNAL TIME BY 15 SECONDS OR LONGER

| CASE | FIRST RECEPTION TIME DATA | SECOND RECEPTION TIME DATA | CORRECTED TIME |
|---|---|---|---|
| 1 | A1 | NO FIXED-TIME RECEPTION | A1 |
| 2 | B1 | A2 | A2 |
| 3 | B1 | B2 (WHICH CONFORMS WITH B1) | B2 |
| 4 | B1 | B3 (WHICH DOES NOT CONFORM WITH B1) | NO CORRECTION |

※ A1 AND A2 ARE TIMES THAT DIFFER FROM INTERNAL TIME BY PERIOD SMALLER THAN 15 SECONDS
B1, B2 AND B3 ARE TIMES THAT DIFFER FROM THE INTERNAL TIME BY 15 SECONDS OR LONGER

FIG. 13

RADIO CONTROLLED TIMEPIECE AND METHOD FOR CONTROLLING RADIO CONTROLLED TIMEPIECE

BACKGROUND

1. Technical Field

The present invention relates to a radio controlled timepiece that receives a standard radio wave and a method for controlling the radio controlled timepiece.

2. Related Art

There has been a known radio correction timepiece that receives a standard radio wave at a fixed point of time and corrects internal time based on time data contained in the received standard radio wave (see JP-2002-181963, for example).

The radio correction timepiece described in JP-2002-181963 performs the reception and the time correction at a plurality of points of time set in advance (such as 12, 1, 2, 3, 4, and 8 o'clock).

The radio correction timepiece described in JP-2002-181963 undesirably consumes a large amount of electric power because the reception is performed a large number of times per day (six times per day). To lower the power consumption, it is conceivable to perform the reception, for example, once a day.

In this case, however, if the reception is performed at a point of time within a noisy time zone in a reception environment, time data may not undesirably be received, or even if time data can be received, the received time data may be incorrect and time correction is undesirably performed based on the incorrect time data, resulting in inaccurate time correction.

SUMMARY

An advantage of some aspects of the invention is to provide a radio controlled timepiece capable of accurately correcting time and a method for controlling the radio controlled timepiece.

A radio controlled timepiece according to an aspect of the invention includes a reception section that receives a standard radio wave, a reference signal source that produces a reference signal, a time measurement section that measures internal time based on the reference signal, a reception control section that causes the reception section to operate and carries out a reception process, and a time correction section that corrects the internal time. The reception control section carries out the reception process at first time to acquire first reception time data, compares the acquired first reception time data with the internal time, and carries out the reception process at second time different from the first time to acquire second reception time data when a difference in time between the first reception time data and the internal time is greater than or equal to a preset first threshold. The time correction section compares the acquired second reception time data with the internal time and corrects the internal time based on the second reception time data when a difference in time between the second reception time data and the internal time is smaller than a preset second threshold.

The first time is, for example, 2 AM, and the second time is, for example, 4 AM. Each of the first and second thresholds is 15 seconds, which is the accuracy per month of a typical quartz timepiece.

According to the aspect of the invention, when the difference in time between the first reception time data acquired at the first time and the internal time is greater than or equal to the first threshold, and it cannot be evaluated whether or not the first reception time data is correct, the reception process is carried out at the second time to acquire second reception time data. When the difference in time between the second reception time data and the internal time is smaller than the second threshold, and it is determined that the second reception time data is correct, the internal time is corrected based on the second reception time data.

In the configuration described above, even when correct reception time data cannot be acquired at the first time in a noisy reception environment, if the environment changes with time and the amount of noise decreases at the second time in the reception environment, correct reception time data can be acquired at the second time. The possibility of accurate correction of the internal time can therefore be increased as compared with a case where reception time data is acquired only at the first time.

Further, the evaluation of whether or not reception time data is correct, which is performed by comparison of the reception time data with the internal time, can be performed even when the type of the standard radio wave is, for example, the standard radio wave WWVB in the United States of America, which contains no parity bit.

When the difference in time between the first reception time data and the internal time is smaller than the first threshold, and it is determined that the first reception time data is correct, the internal time can be corrected based on the first reception time data. In this case, the power consumption can be lowered as compared with a case where the reception process is always carried out at the first time and the second time because no reception process needs to be carried out at the second time. When the first reception time data coincides with the internal time, the internal time may not be corrected based on the first reception time data.

It is preferable that the radio controlled timepiece according to the aspect of the invention further includes a storage section, and the reception control section causes the storage section to store the acquired first reception time data when the difference in time between the first reception time data and the internal time is greater than or equal to the first threshold, and that the time correction section compares the second reception time data with the first reception time data stored in the storage section when the difference in time between the second reception time data and the internal time is greater than or equal to the second threshold and corrects the internal time based on the second reception time data when conformity is verified between the second reception time data and the first reception time data.

In the configuration described above, the time correction section determines that the conformity is verified between the second reception time data and the first reception time data when the difference in time between the second reception time data and the first reception time data is equal to the difference in time between the internal time acquired when the second reception time data is received and the internal time acquired when the first reception time data is received.

According to the aspect of the invention with the configuration described above, when the difference in time between the second reception time data acquired at the second time and the internal time is greater than or equal to the second threshold and it cannot therefore be evaluated whether or not the second reception time data is correct, the second reception time data is compared with the first reception time data acquired at the first time. When conformity is verified between the second reception time data and the first reception time data, and it is therefore determined that each of the second reception time data and the first reception time data is correct time data, the internal time is corrected based on the second reception time data.

As a result, even when the internal time deviates from correct time by an amount greater than or equal to the first or second threshold, but when the first reception time data and the second reception time data are correct, the internal time can be accurately corrected.

In the radio controlled timepiece according to the aspect of the invention, it is preferable that the time correction section does not correct the internal time based on the second reception time data when conformity is not verified between the second reception time data and the first reception time data.

According to the aspect of the invention with the configuration described above, when the second reception time data and the first reception time data are not verified to conform with each other, it is determined that at least one of the second reception time data and the first reception time data is incorrect, and the internal time is likely to be correct. The internal time is therefore not corrected based on the second reception time data, whereby a situation in which the internal time is corrected to incorrect time can be avoided.

In the radio controlled timepiece according to the aspect of the invention, it is preferable that the reception section is configured to be capable of receiving a plurality of types of standard radio wave, and that when the type of the standard radio wave received by the reception section is a predetermined type set in advance, the reception control section compares the acquired first reception time data with the internal time and carries out the reception process at the second time to acquire the second reception time data when the difference in time between the first reception time data and the internal time is greater than or equal to the first threshold, whereas when the type of the standard radio wave received by the reception section is not the predetermined type, the time correction section corrects the internal time based on the first reception time data when conformity of the acquired first reception time data is verified.

The standard radio wave of the predetermined type is, for example, a standard radio wave containing no parity bit, such as WWVB.

A standard radio wave containing no parity bit does not allow evaluation of whether or not first reception time data is correct based on information on received data itself. Whether or not the first reception time data is correct is therefore evaluated by comparison of the first reception time data with the internal time.

On the other hand, for example, a standard radio wave containing a parity bit (for example, standard radio wave JJY in Japan) allows determination of correctness of first reception time data as long as the parity bit is used to verify the conformity of the first reception time data. The internal time can therefore be immediately corrected by correction of the internal time based on the first reception time data. Further, in this case, since no reception process needs to be carried out at the second time, the power consumption can be lowered as compared with a case where the reception process is always carried out at the first time and the second time. When the conformity of the first reception time data is not verified, the reception process may be carried out at the second time, or the reception process may be carried out at the first time on the following day.

It is preferable that the radio controlled timepiece according to the aspect of the invention further includes a storage section and a threshold setting section that sets the first threshold and the second threshold, and when the time correction section corrects the internal time by using reception time data acquired in the reception process carried out by the reception section that is caused to be in operation, the time correction section causes the storage section to store the reception time data as reception success time, and that the threshold setting section sets the first threshold and the second threshold in accordance with a period having elapsed since the reception success time.

The difference in time between the internal time and correct time increases as the period having elapsed since the internal time was corrected increases due to the precision of the reference signal source. For example, when the elapsed period is one month, the time difference is 15 seconds at the maximum, and when the elapsed period is two months, the time difference is 30 seconds at the maximum.

Therefore, when the elapsed period described above is, for example, longer than or equal to one month, the time difference from the internal time is possibly longer than or equal to 15 seconds even in the case where the first reception time data or the second reception time data is correct. Therefore, when each of the first and second thresholds is fixed, for example, at 15 seconds, the time difference described above is longer than or equal to the first and second thresholds even in the case where each reception time data is correct, and the reception time data is not determined to be correct.

In contrast, the threshold setting section can be configured to increase the first and second thresholds as the elapsed period described above increases. For example, the threshold setting section may initially set the first and second thresholds at 15 seconds, and then set the first and second thresholds at 30 seconds when the elapsed period described above reaches one month. The thus set first and second thresholds allow correct evaluation of whether or not each reception time data is correct even when the elapsed period described above is longer than or equal to one month.

It is preferable that the radio controlled timepiece according to the aspect of the invention further includes a storage section, and when the time correction section corrects the internal time by using reception time data acquired in the reception process carried out by the reception section that is caused to be in operation, the time correction section causes the storage section to store the reception time data as reception success time, and that when a period having elapsed since the reception success time is shorter than a preset elapsed time threshold, the reception control section compares the acquired first reception time data with the internal time and carries out the reception process at the second time to acquire the second reception time data in the case where the difference in time between the first reception time data and the internal time is greater than or equal to the first threshold, whereas when the period having elapsed since the reception success time is longer than or equal to the elapsed time threshold, the time correction section corrects the internal time based on the acquired first reception time data.

The elapsed period threshold is set, for example, at six months.

When the elapsed time described above is longer than or equal to the elapsed time threshold, the internal time possibly deviates from correct time by a large amount. Further, it cannot be evaluated whether or not first reception time data is correct even by comparison of the first reception time data with the internal time. In this case, the internal time can be immediately corrected by correction of the internal time based on the first reception time data. Further, in this case, since no reception process is carried out at the second time, the power consumption can be lowered as compared with a case where the reception process is always carried out at the first time and the second time.

It is preferable that the radio controlled timepiece according to the aspect of the invention further includes an operation section and a manual reception control section that causes the reception section to operate and carries out the reception process when manual reception operation is performed on the operation section, and the time correction section preferably does not compare reception time data acquired in the reception process carried out by the manual reception control section with the internal time but corrects the internal time based on the reception time data.

Since a case where the manual reception operation is performed is a case where a user desires to correct time, it is expected that the internal time deviates from correct time. In this case, comparison of reception time data with the internal time does not allow evaluation of whether or not the reception time data is correct. In this case, the internal time is corrected based on reception time data without comparison of the reception time data with the internal time for immediate correction of the internal time.

In the radio controlled timepiece according to the aspect of the invention, it is preferable that the reception control section receives time data corresponding to a plurality of frames in the reception process at the first time and, when conformity of the time data is verified among the frames, acquires newest time data as the first reception time data, and the reception control section further receives time data corresponding to a plurality of frames in the reception process at the second time and, when conformity of the time data is verified among the frames, acquires newest time data as the second reception time data.

According to the aspect of the invention with the configuration described above, since whether or not the first reception time data or the second reception time data is correct can be more precisely evaluated, the internal time can be more accurately corrected.

Another aspect of the invention relates to a method for controlling a radio controlled timepiece including a reference signal source that produces a reference signal and a time measurement section that measures internal time based on the reference signal, the method including carrying out a reception process of receiving a standard radio wave at first time to acquire first reception time data, comparing the acquired first reception time data with the internal time, carrying out the reception process of receiving the standard radio wave at second time different from the first time to acquire second reception time data when a difference in time between the first reception time data and the internal time is greater than or equal to a preset first threshold, comparing the acquired second reception time data with the internal time, and correcting the internal time based on the second reception time data when a difference in time between the second reception time data and the internal time is smaller than a preset second threshold.

According to the aspect of the invention, the same advantageous effects as those provided by the radio controlled timepiece described above can be provided.

BRIEF DESCRIPTION OF THE DRAWINGS

The invention will be described with reference to the accompanying drawings, wherein like numbers reference like elements.

FIG. 13 shows an example of correction of internal time in the first embodiment.

DESCRIPTION OF EXEMPLARY EMBODIMENTS

First Embodiment

Configuration of Radio Correction Timepiece

Figure 1:
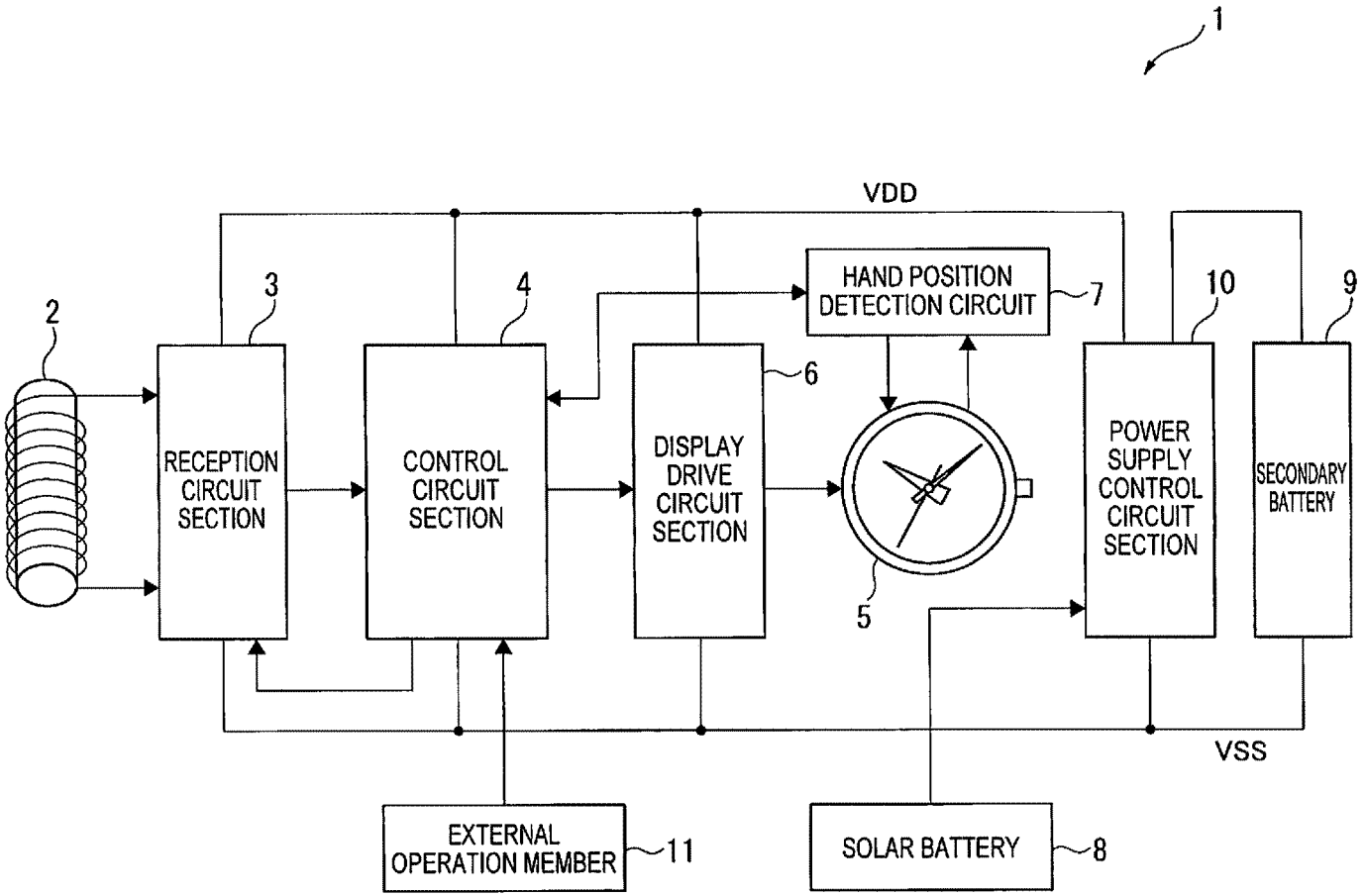
FIG. 1 shows a schematic configuration of a radio correction timepiece according to a first embodiment of the invention.
Figure 2:
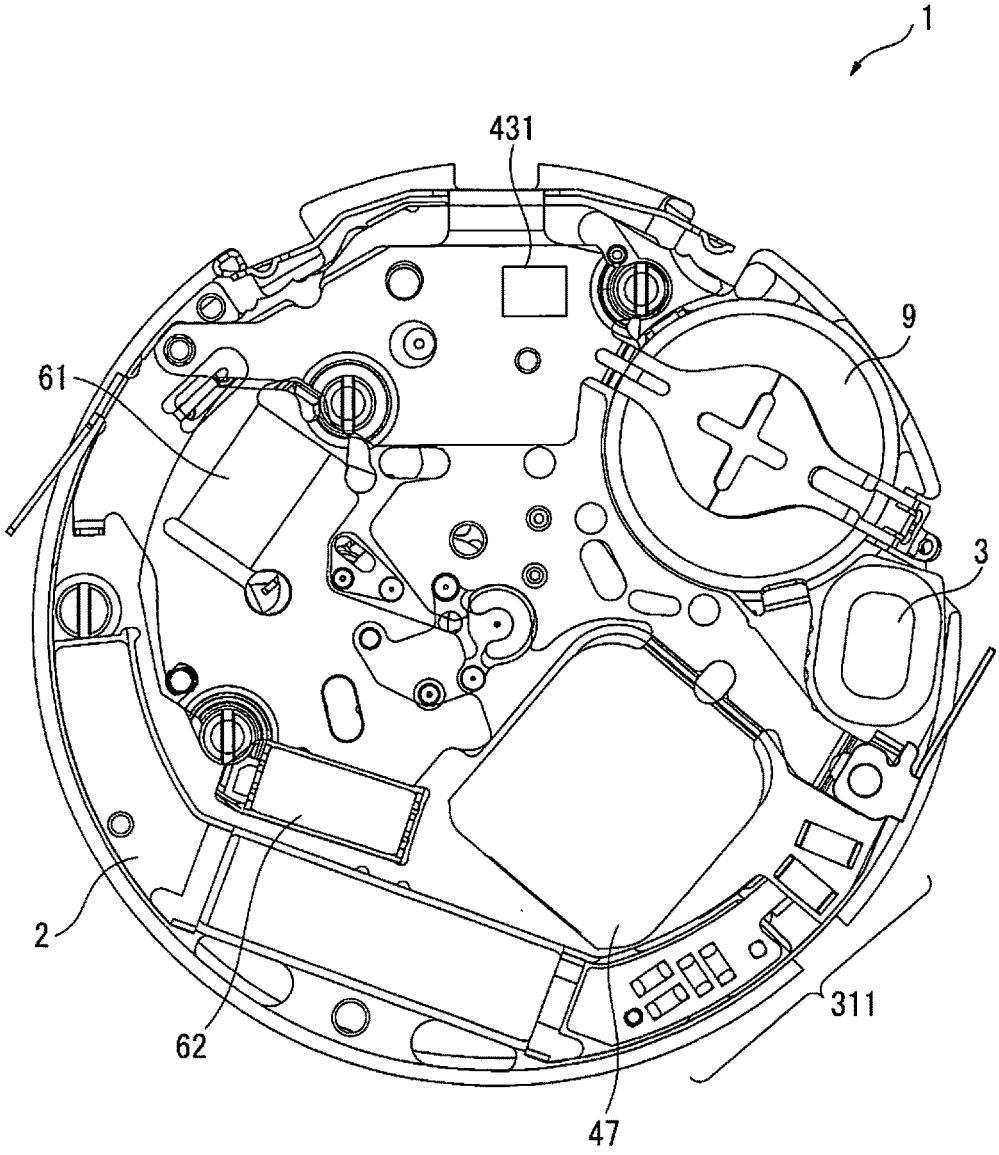
FIG. 2 is a plan view showing an internal structure of the radio correction timepiece in the first embodiment.

FIG. 1 shows a schematic configuration of a radio correction timepiece 1, and FIG. 2 is a plan view showing an internal structure of the radio correction timepiece 1.

The radio correction timepiece 1 as a radio controlled timepiece includes an antenna 2, a reception circuit section 3, a control circuit section 4, a display section 5, a display drive circuit section 6, a hand position detection circuit 7, a solar battery 8, a secondary battery 9, such as a lithium ion battery, a power supply control circuit section 10, and an external operation member 11, as shown in FIG. 1. Among the components described above, FIG. 2 shows the antenna 2, the reception circuit section 3, a central control circuit 47 provided in the control circuit section 4, and the secondary battery 9.

The antenna 2 receives a long-wave standard radio wave (hereinafter referred to as "standard radio wave") and outputs the received standard radio wave to the reception circuit section 3.

The reception circuit section 3 demodulates a received signal formed of the standard radio wave received at the antenna 2 and outputs the demodulated signal as a TCO (time code output) signal to the control circuit section 4. The reception circuit section 3 will be described later in detail.

The control circuit section 4 decodes the inputted TCO signal to produce a TC (time code) and corrects the time counted by a time counter 471 (see FIG. 4), which will be described later, based on the produced TC. The control circuit section 4 further controls the display section 5 to cause it to display the time counted by the time counter 471. The control circuit section 4 further outputs a control signal to the reception circuit section 3. The control circuit section 4 will be described later in detail.

The display section 5 is driven and controlled by the display drive circuit section 6, which will be described later, to display time. The display section 5 includes a dial and indication hands and moves the indication hands to display time. The display section 5 may instead include, for example, a liquid crystal panel and display time on the liquid crystal panel.

The display drive circuit section 6 controls the display state of the display section 5 based on a time display control signal outputted from the control circuit section 4 to cause the display section 5 to display time. Specifically, the display drive circuit section 6 outputs a pulse signal to a stepping motor that drives the indication hands to cause the stepping motor to move the indication hands based on drive force produced by the stepping motor. In the present embodiment, the radio correction timepiece 1 includes a stepping motor 61, which drives an hour hand and a minute hand, and a stepping motor 62, which drives a second hand, as shown in FIG. 2. When the display section 5 has a liquid crystal panel and causes the liquid crystal panel to display time, the display drive circuit section 6 controls the liquid crystal panel based on the time display control signal to cause the liquid crystal panel to display time.

The hand position detection circuit 7 detects the positions of the indication hands of the display section 5 and outputs a result of the detection to the control circuit section 4.

The solar battery 8 generates electricity from light incident thereon and outputs generated current to the power supply control circuit section 10. The power supply control circuit section 10 supplies the secondary battery 9 with the generated current inputted from the solar battery 8 to charge the secondary battery 9. The power supply control circuit section 10 has a built-in voltage detection circuit and has an over-charging prevention function of preventing the generated current from being supplied to the secondary battery 9 when the voltage across the secondary battery 9 is greater than or equal to predetermined voltage. The power supply control circuit section 10 further supplies electronic components that form the radio correction timepiece 1 (for example, reception circuit section 3, control circuit section 4, and display drive circuit section 6) with current supplied from the secondary battery 9.

The external operation member 11 is formed, for example, of a crown and a setting button and operated by a user to output a predetermined operation signal to the control circuit section 4. Examples of the operation signal may include ratio wave type setting data for setting the type of the standard radio wave received at the antenna 2 (for example, JJY in Japan, WWVB in the United States of America, DCF77 in Germany, MSF in England, and BPC in China) and a manual reception signal for reception of a standard radio wave and correction of time.

The external operation member 11 forms an operation section according to an embodiment of the invention.

Reception Circuit Section

Figure 3:
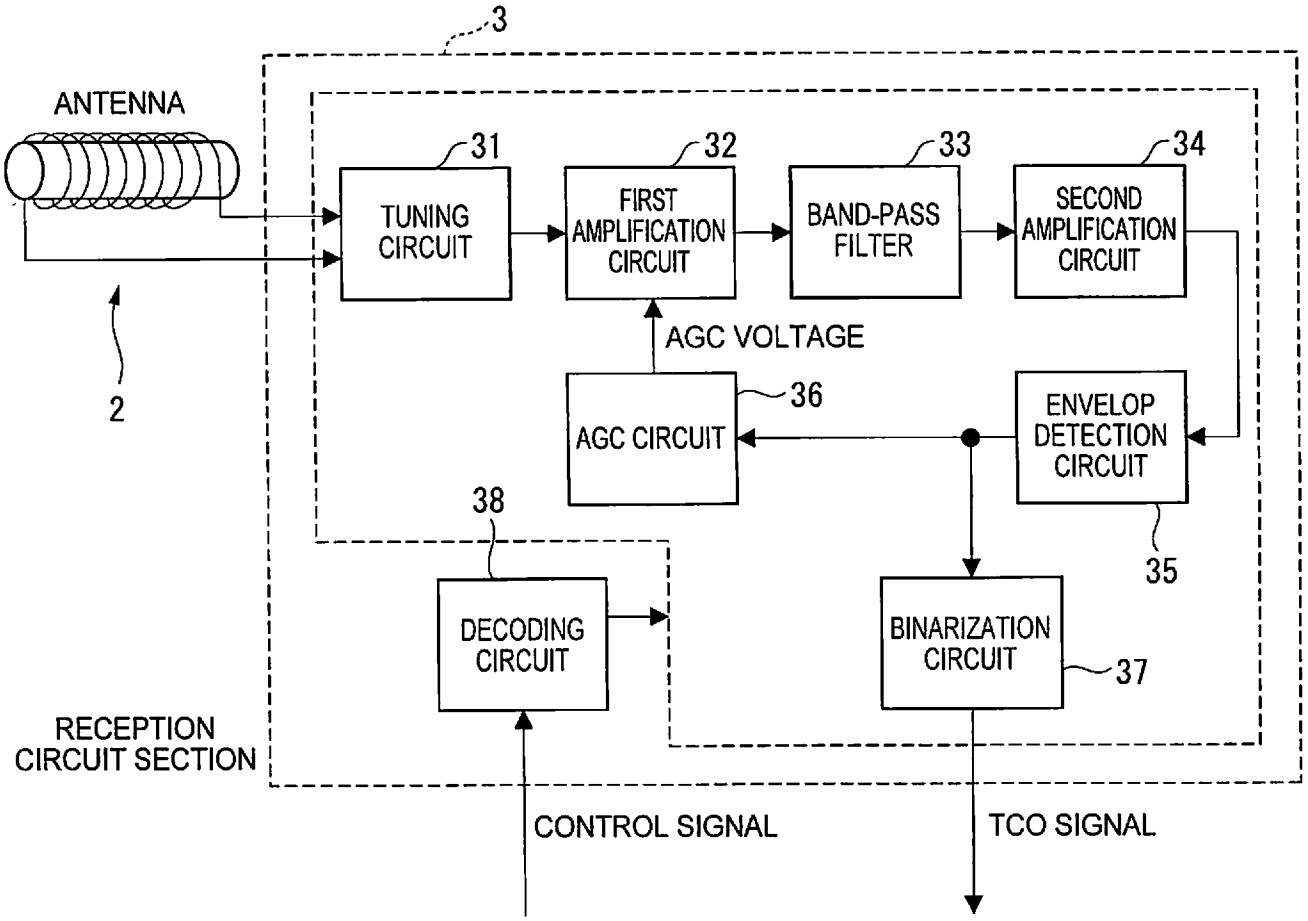
FIG. 3 shows the configuration of a reception circuit section in the first embodiment.

The reception circuit section 3 includes a tuning circuit 31, a first amplification circuit 32, a band-pass filter (hereinafter abbreviated to "BPF" in some cases) 33, a second amplification circuit 34, an envelope detection circuit 35, an AGC (automatic gain control) circuit 36, a binarization circuit 37, and a decoding circuit 38, as shown in FIG. 3. The reception circuit section 3 forms a reception section according to an embodiment of the invention.

The tuning circuit 31 includes capacitors 311 (FIG. 2), and the tuning circuit 31 and the antenna 2 form a parallel resonance circuit. The tuning circuit 31 causes the antenna 2 to receive a radio wave of a specific frequency. The tuning circuit 31 converts the standard radio wave received at the antenna 2 into a voltage signal and outputs the voltage signal to the first amplification circuit 32. The reception circuit section 3 in the present embodiment is configured to be capable of receiving a standard radio wave in each region, such as the standard radio wave JJY in Japan, the standard radio wave WWVB in the United States of America, the standard radio wave DCF77 in Germany, the standard radio wave MSF in England, and the standard radio wave BPC in China. Standard radio waves of different frequencies can be received by causing a transistor to switch the type of the capacitor 311 to be connected to the antenna 2 so that a tuning frequency is switched to a desired frequency. The control of the transistor is performed in accordance with a control signal from the control circuit section 4.

Time Code Format

Time information (time code) is configured in accordance with a predetermined time information format (time code format) on a country basis.

Figure 5:
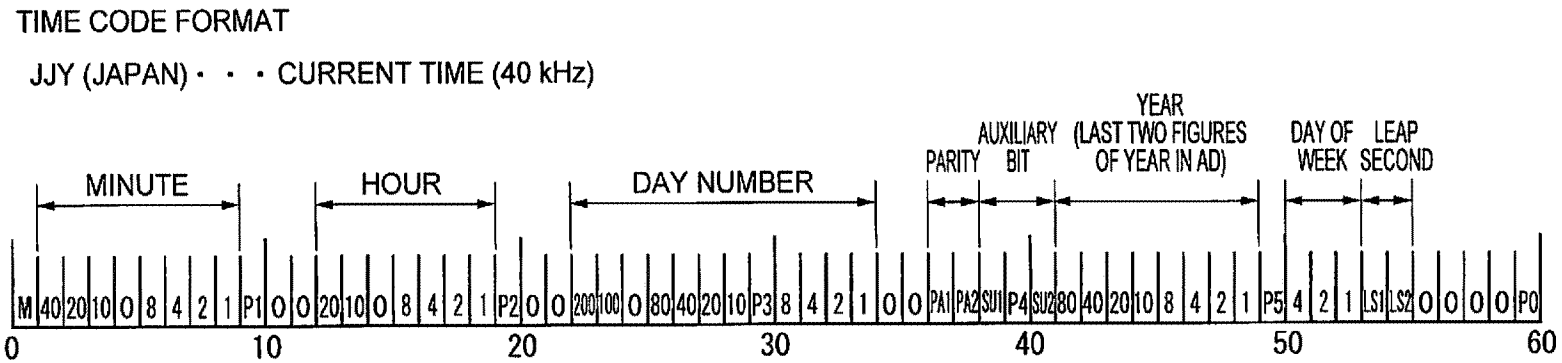
FIG. 5 shows the time code format of the standard radio wave JJY in Japan.

That is, in the time code format of the standard radio wave JJY in Japan shown in FIG. 5, a single signal is transmitted every second, and a single record (single frame) that lasts for 60 seconds forms the time code. That is, a single frame is formed of 60-bit data. The time code contains, as data items, the minute and hour of the current time, the day number counted from January 1st of the current year, the year (last two figures of the year in AD), a day of the week, the "leap second," and other parameters. The values of the items are expressed by a combination of numerals each assigned for each second (for each bit), and the combination is identified from the type of the signal. Further, a parity bit PA1, which corresponds to the hour, and a parity bit PA2, which corresponds to the minute, are inserted between the bit row representing the day number and the bit row representing the year. The character "M" shown in FIG. 5 is a marker corresponding to the minute (0 second at each minute), and the characters "P1 to P5" are position markers. Each of the markers is a signal the position of which is determined in advance.

Figure 6:
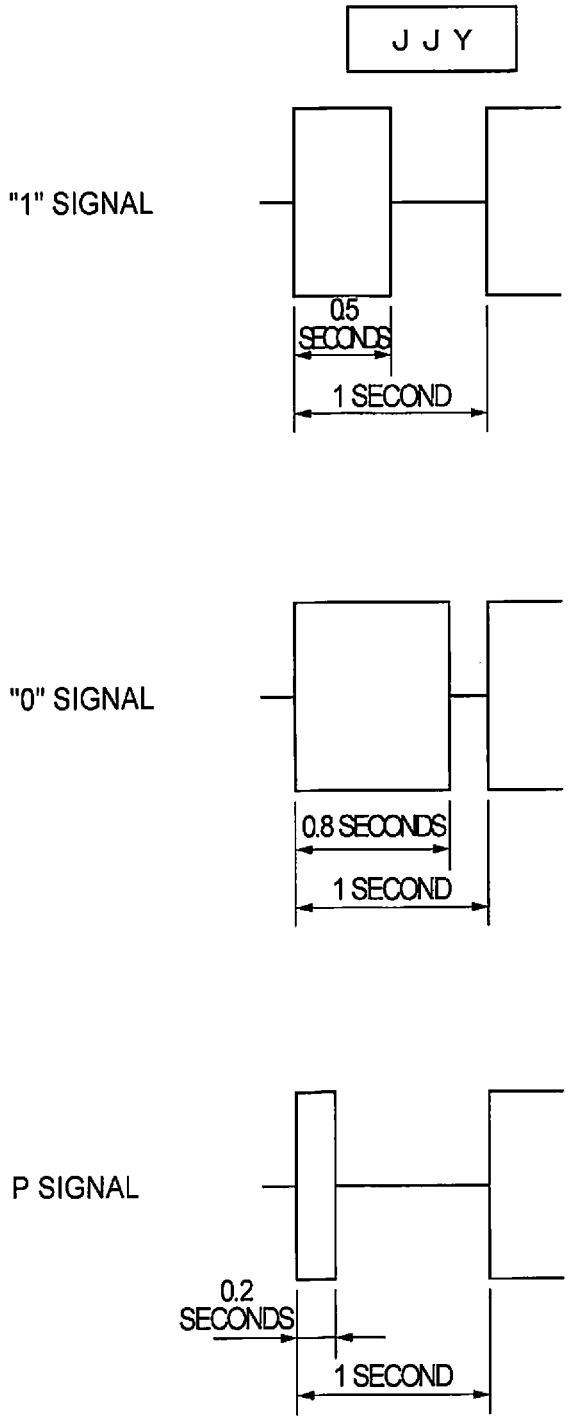
FIG. 6 shows signals that form the standard radio wave JJY in Japan.

In each of the items, the signal representing "1" is a signal having a pulse width of about 0.5 seconds, the signal representing "0" is a signal having a pulse width of about 0.8 seconds, and a signal P representing each of the markers is a signal having a pulse width of about 0.2 seconds, as shown in FIG. 6.

Figure 7:
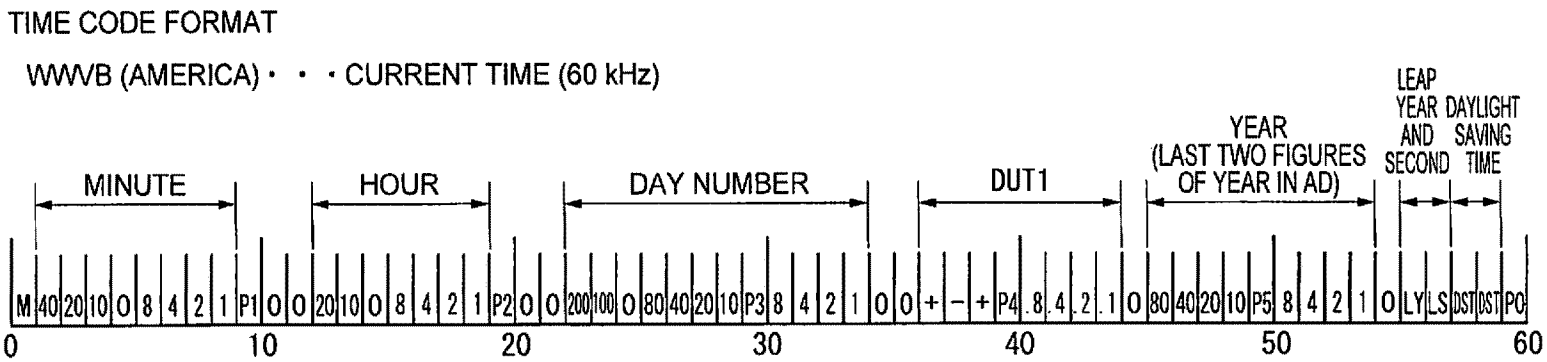
FIG. 7 shows the time code format of the standard radio wave WWVB in the United States of America.

In the time code format of the standard radio wave WWVB in the United States of America shown in FIG. 7, a single frame is formed of 60-bit data, and the time code contains, as data items, the minute and hour of the current time, the day number in the year, the year (last two figures of the year in AD), the "leap year and second," the "daylight saving time," and other parameters. The WWVB format contains no parity bit.

Figure 8:
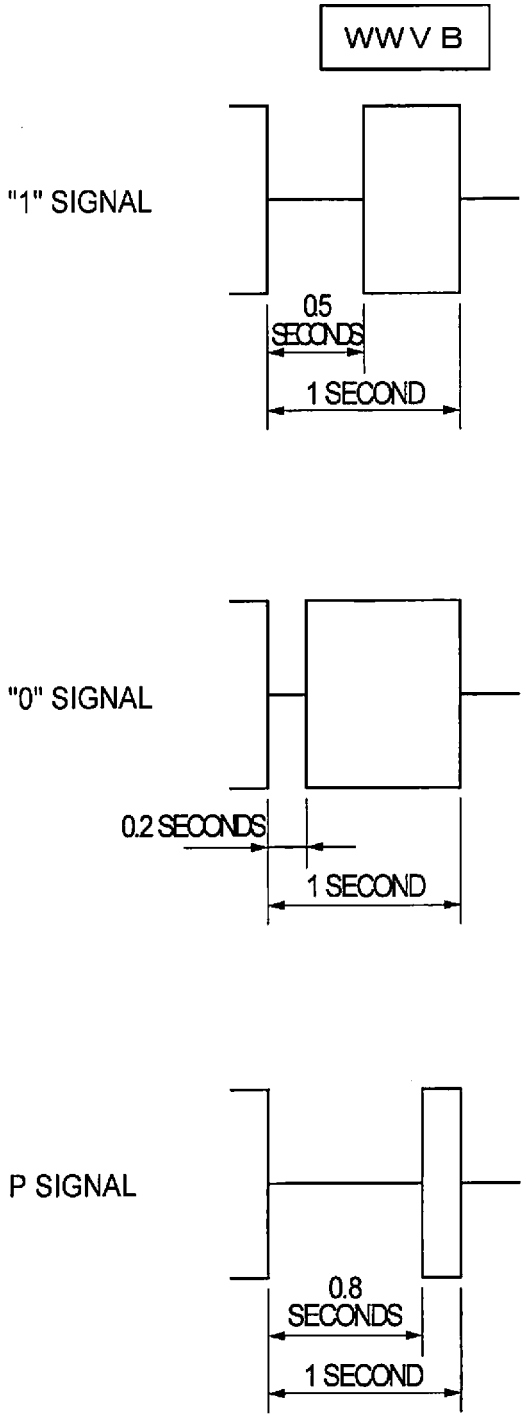
FIG. 8 shows signals that form the standard radio wave WWVB in the United States of America.

In WWVB, in each of the items, the signal representing "1" is a signal including an L-level signal portion having a width of about 0.5 seconds, the signal representing "0" is a signal including an L-level signal portion having a width of about 0.2 seconds, and the signal labeled with "P" is a signal including an L-level signal portion having a width of about 0.8 seconds, as shown in FIG. 8.

In the above description, identification of the time codes (TCs) in JJY and WWVB is shown by way of example. When standard radio waves of other types are received, the TC identification is performed based on the pulse widths (duties) corresponding to each radio wave.

The first amplification circuit 32 adjusts the gain thereof in accordance with a signal (AGC voltage) inputted from the AGC circuit 36, which will be described later, and amplifies the received signal inputted from the tuning circuit 31 in such a way that the amplified signal having a fixed amplitude is outputted to the BPF 33.

The band-pass filter (BPF) 33 is a filter that extracts a signal of a desired frequency band. That is, when the received signal inputted from the first amplification circuit 32 passes through the BPF 33, the carrier component is extracted from the signal but the other components are removed therefrom.

The second amplification circuit 34 further amplifies the received signal inputted from BPF 33 by the factor of fixed gain.

The envelope detection circuit 35 includes a rectifier that is not shown and a low-pass filter (LPF) that is not shown, rectifies and filters the received signal inputted from the second amplification circuit 34, and outputs an envelope signal resulting from the filtration to the AGC circuit 36 and the binarization circuit 37.

The AGC circuit 36 outputs a signal (AGC voltage) that determines, on the basis of the received signal inputted from the envelope detection circuit 35, the gain used when the first amplification circuit 32 amplifies the received signal.

The binarization circuit 37 is formed, for example, of a binarization comparator. The binarization comparator has hysteresis and compares the envelope signal inputted from the envelope detection circuit 35 with reference voltage that is predetermined voltage and outputs a binarized signal, that is, a TCO signal. The envelope signal is noisy, and the binarization comparator having hysteresis of several millivolts can suppress chattering of the TCO signal.

Specifically, the binarization circuit 37 outputs, as the TCO signal to the control circuit section 4, a signal having H-level (high-level) voltage when the voltage of the envelope signal is greater than the reference voltage, whereas outputting, an L-level (low-level) signal having voltage lower than the voltage of the H-level signal when the voltage of the envelope signal is smaller than the reference voltage. The binarization circuit 37 can instead be so configured that it outputs, as the TCO signal to the control circuit section 4, the L-level signal when the voltage of the envelope signal is greater than the reference voltage, whereas outputting the H-level signal when the voltage of the envelope signal is smaller than the reference voltage.

The decoding circuit 38 is connected to the control circuit section 4, which will be described later, via a serial communication line. The decoding circuit 38 decodes a control signal inputted from the control circuit section 4 and outputs the decoded control signal to the circuits that form the reception circuit section 3.

Control Circuit Section

The control circuit section 4 controls the action of the reception circuit section 3. Specifically, the control circuit section 4 outputs, for example, a control signal for causing the reception circuit section 3 to operate to the decoding circuit 38 in the reception circuit section 3. The control circuit section 4 further decodes the TCO signal inputted from the binarization circuit 37 and corrects the time counted by the time counter 471 based on the time code produced in the decoding process. The control circuit section 4 further controls the display section 5 to cause it to display the time counted by the time counter 471.

Figure 4:
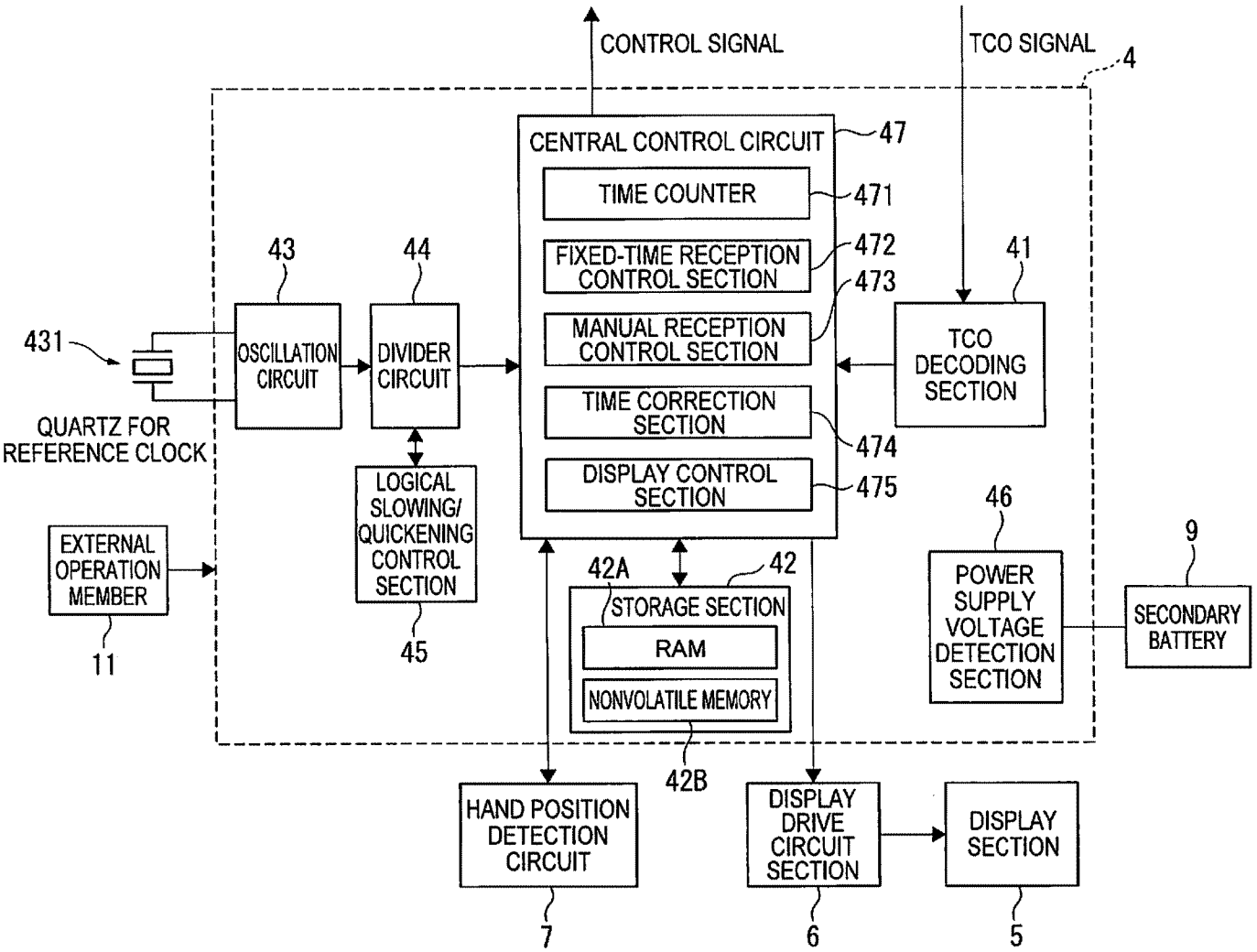
FIG. 4 shows the configuration of a control circuit section in the first embodiment.

The control circuit section 4 includes a TCO decoding section 41, a storage section 42, an oscillation circuit 43, a divider circuit 44, a logical slowing/quickening control section 45, a power supply voltage detection section 46, and a central control circuit 47, as shown in FIG. 4.

The TCO decoding section 41 decodes the TCO signal inputted from the binarization circuit 37 in the reception circuit section 3 and extracts the time code (TC) contained in the TCO signal and having date information, time information (time data), and other types of information. The TCO decoding section 41 then outputs the extracted TC to the central control circuit 47. The TCO decoding section 41 in the present embodiment is configured to be capable of decoding a plurality of types of standard radio wave, such as the standard radio wave JJY in Japan, the standard radio wave WWVB in America, the standard radio wave DCF77 in Germany, the standard radio wave MSF in England, and the standard radio wave BPC in China, and outputting a decoded time code.

The storage section 42 is a memory that stores a variety of data, programs, and other types of information necessary for the control circuit section 4 to control the reception circuit section 3 and perform other types of operation. The storage section 42 includes a RAM (random access memory) 42A and a nonvolatile memory 42B, the latter of which is, for example, an EEPROM (electronically erasable and programmable read only memory) and a flash memory.

Figure 9:
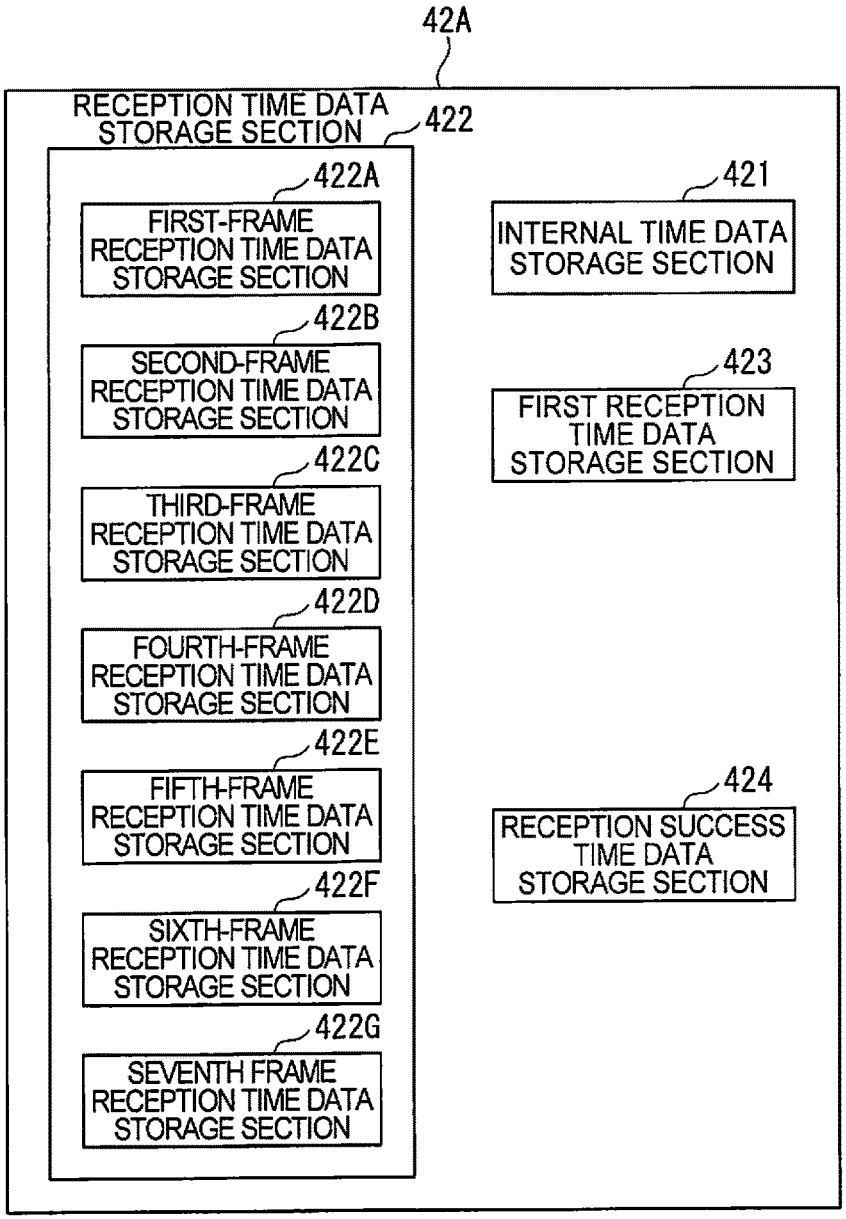
FIG. 9 shows a data structure of a storage section in the first embodiment.

The RAM 42A includes an internal time data storage section 421, which stores time (internal time) counted by the time counter 471, which will be described later, a reception time data storage section 422, which stores data on reception time, a first reception time data storage section 423, which stores first reception time data acquired at first time, which will be described later, and a reception success time data storage section 424, which stores reception success time in the form of the newest time when reception is successful and the internal time is corrected, as shown in FIG. 9.

The reception time data storage section 422 is configured to be capable of storing time data corresponding to seven frames. Specifically, the reception time data storage section 422 includes a first-frame reception time data storage section 422A, which stores time data corresponding to a received first frame, a second-frame reception time data storage section 422B, which stores time data corresponding to a received second frame, a third-frame reception time data storage section 422C, which stores time data corresponding to a received third frame, a fourth-frame reception time data storage section 422D, which stores time data corresponding to a received fourth frame, a fifth-frame reception time data storage section 422E, which stores time data corresponding to a received fifth frame, a sixth-frame reception time data storage section 422F, which stores time data corresponding to a received sixth frame, and a seventh-frame reception time data storage section 422G, which stores time data corresponding to a received seventh frame.

The nonvolatile memory 42B stores setting data on circuit parameters of the reception circuit section 3 and other types of information.

The oscillation circuit 43 uses a quartz oscillator 431 (FIGS. 2 and 4) for a reference clock provided external to the control circuit section 4 to produce a reference signal (reference clock) of a predetermined frequency (32.768 kHz, for example) and outputs the reference signal to the divider circuit 44. The quartz oscillator 431 forms a reference signal source according to an embodiment of the invention.

The divider circuit 44 divides the reference signal inputted from the oscillation circuit 43 to produce a 1-Hz signal and outputs the 1-Hz signal to the central control circuit 47.

The logical slowing/quickening control section 45 periodically changes the division ratio of the divider circuit 44 to adjust an error of the frequency of the reference signal due, for example, to quartz variation of the quartz oscillator 431.

The power supply voltage detection section 46 detects battery voltage across the secondary battery 9 at preset time intervals.

Central Control Circuit

The central control circuit 47 is formed of a CPU (central processing unit), and the CPU executes a program stored in the storage section 42 to allow the central control circuit 47 to function as the time counter 471, a fixed-time reception control section 472, a manual reception control section 473, a time correction section 474, and a display control section 475.

The time counter 471 counts time based on the signal inputted from the divider circuit 44. Specifically, the time counter 471 includes a second counter that counts the second, a minute counter that counts the minute, and an hour counter that counts the hour. The time counted by the time counter 471 is internal time. That is, the time counter 471 forms a time measurement section according to an embodiment of the invention.

The fixed-time reception control section 472 outputs a power-on signal to the reception circuit section 3 when the internal time reaches preset time to cause the reception circuit section 3 to operate and carries out a reception process of receiving a standard radio wave. The fixed-time reception control section 472 forms a reception control section according to an embodiment of the invention.

The manual reception control section 473 outputs, when manual reception operation is performed on the external operation member 11, the power-on signal to the reception circuit section 3 to cause it to operate and carries out the reception process of receiving a standard radio wave.

The time correction section 474 outputs the TC inputted from the TCO decoding section 41 to the time counter 471 to correct the count provided by the time counter 471. The internal time is thus corrected.

The display control section 475 outputs a time display control signal to the display drive circuit section 6 to cause the display section 5 to display the internal time.

The function of each of the sections of the central control circuit 47 will be described in detail in the following description of time correction action.

Time Correction Action at Fixed Time

Figure 10:
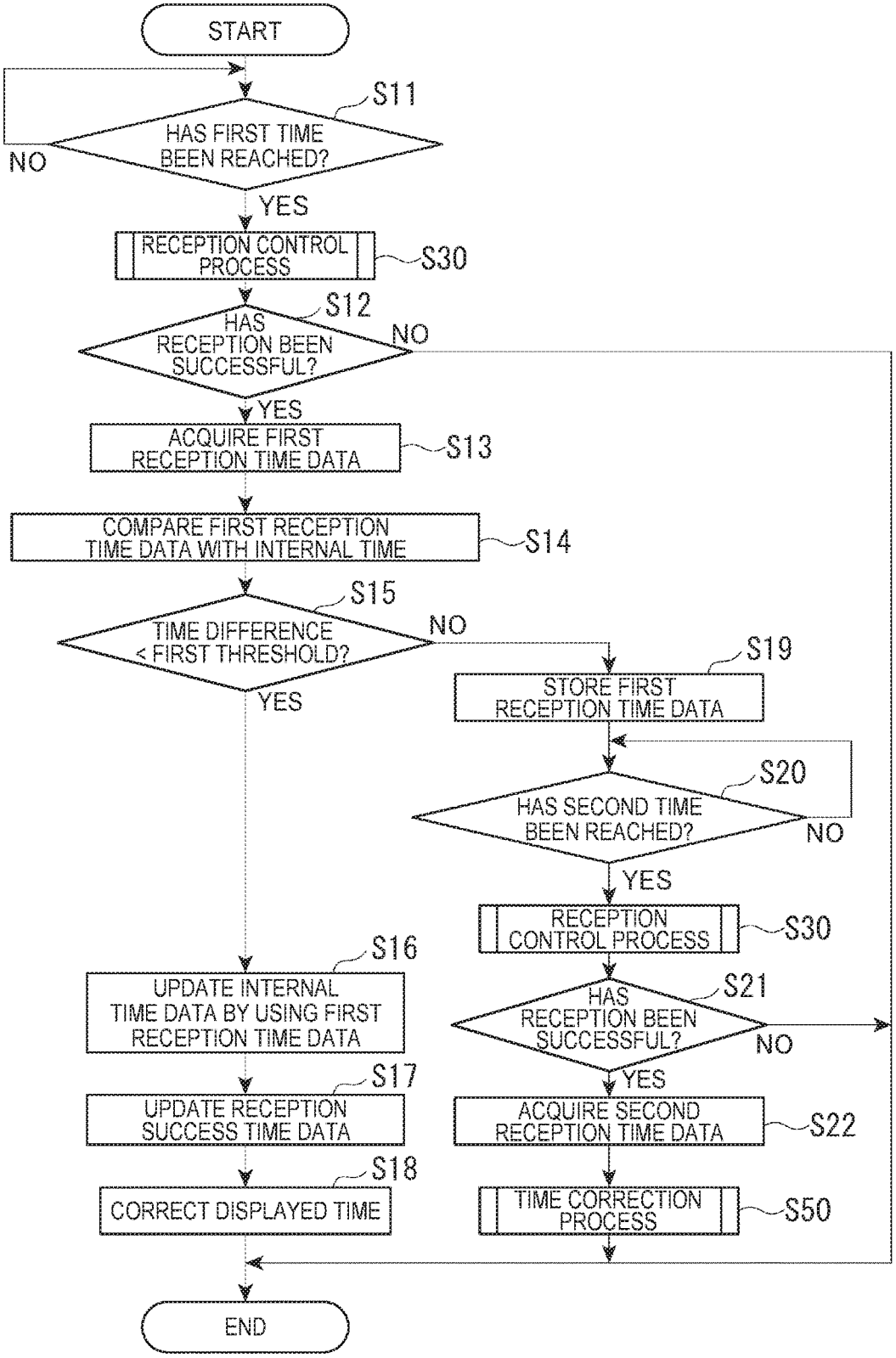
FIG. 10 is a flowchart showing time correction action performed at fixed time in the first embodiment.

FIG. 10 is a flowchart showing the time correction action performed at a point of time set in advance in the radio correction timepiece 1.

At the time of shipment of the radio correction timepiece 1, JJY is, for example, set as the type of a standard radio wave to be received. The radio correction timepiece 1 is therefore so set that it can decode a TC contained in JJY. It is noted that the type of a radio wave to be received can be set by the user through the user's operation of the external operation member 11.

In JJY, the following two types of standard radio wave are present: "JJY40," which uses a 40-kHz carrier wave; and "JJY60," which uses a 60-kHz carrier wave.

The fixed-time reception control section 472 evaluates whether or not the time counted by the time counter 471 (internal time) has reached first time (S11). The first time is, for example, set at 2 AM. When a result of the evaluation in S11 is NO, the fixed-time reception control section 472 performs the evaluation in S11 again.

When a result of the evaluation in S11 is YES, the fixed-time reception control section 472 carries out a reception control process S30.

Figure 11:
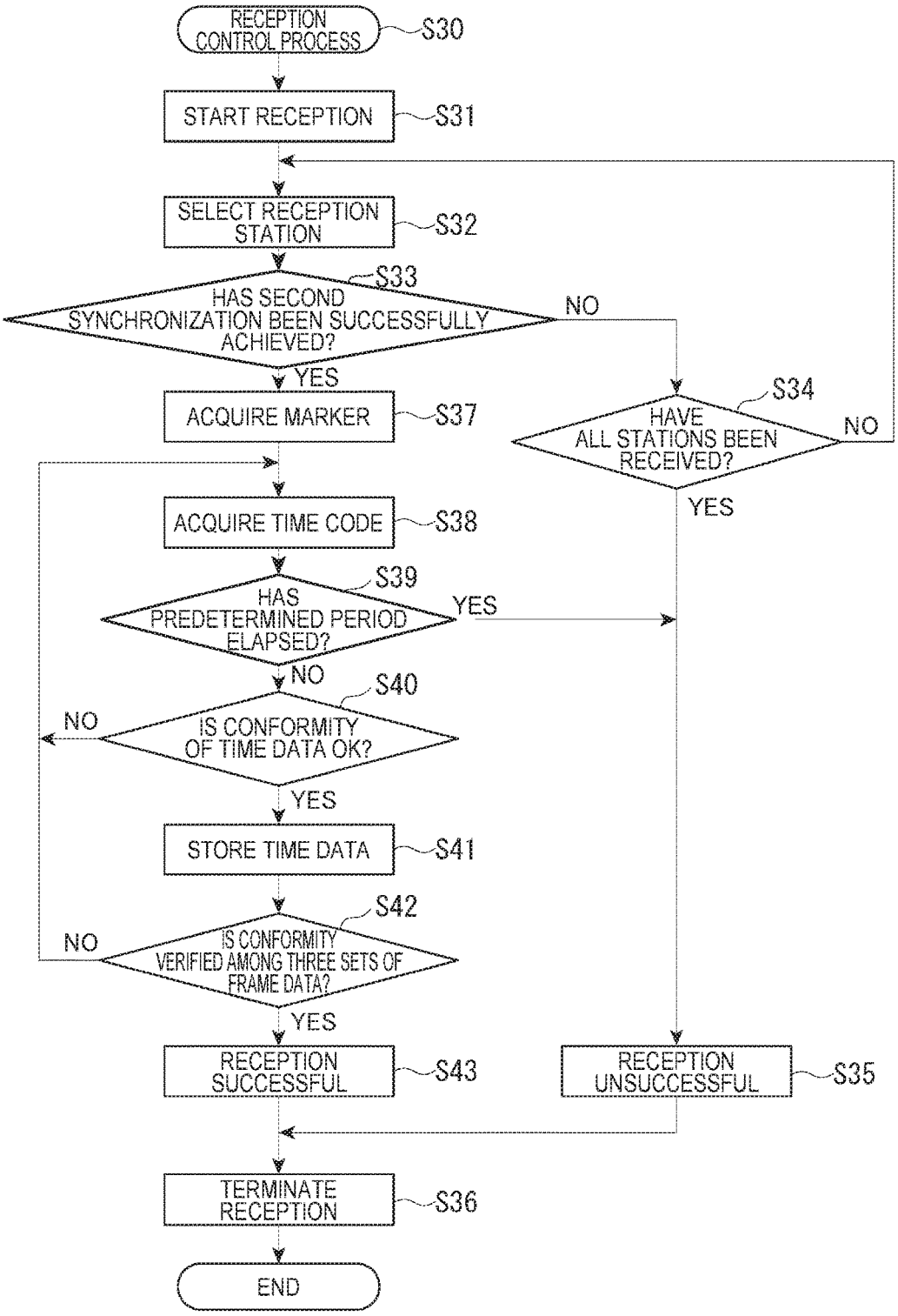
FIG. 11 is a flowchart showing a reception control process in the first embodiment.

FIG. 11 is a flowchart showing the reception control process S30.

Having started the reception control process S30, the fixed-time reception control section 472 causes the reception circuit section 3 to operate and start the process of receiving a standard radio wave (S31).

The fixed-time reception control section 472 then selects a reception station (type of standard radio wave) (S32). The reception station is JJY in the initial setting as described above, but in a case where the user has set a reception station, the set reception station is selected. When JJY is selected, one of the reception stations "JJY40" and "JJY60" that was successfully received last time is selected.

The fixed-time reception control section 472 then evaluates whether or not second synchronization has been successfully achieved based on the TCO signal outputted from the binarization circuit 37 (S33). That is, the reception circuit section 3 causes the tuning circuit 31 to convert the standard radio wave received at the antenna 2 into a voltage signal (reception signal) and causes the first amplification circuit 32, the band-pass filter 33, the second amplification circuit 34, and the envelope detection circuit 35 to amplify the reception signal to a predetermined level, extract a signal of a desired frequency band, and rectify and filter the extracted signal into an envelope signal. Further, the binarization circuit 37 binarizes the envelope signal into a TCO signal and outputs the TCO signal to the control circuit section 4.

At this point, the fixed-time reception control section 472 checks if the TCO signal inputted to the TCO decoding section 41 rises at 1-second intervals to evaluate whether or not the second synchronization has been successfully achieved.

When a result of the evaluation in S33 is NO, the fixed-time reception control section 472 evaluates whether or not all reception stations have been received (S34). That is, since JJY has the two reception stations, "JJY40" and "JJY60," as described above, the fixed-time reception control section 472 produces an evaluation result of NO in S34 when it has not received both the two reception stations and returns to the process in S32. On the other hand, when the two reception stations have been received, the fixed-time reception control section 472 produces an evaluation result of YES in S34. In WWVB and other standards in which the number of reception station is one, a result of the evaluation in S34 is always YES.

When a result of the evaluation in S34 is YES, it is determined that no standard radio wave can be received. The fixed-time reception control section 472 therefore determines that the reception has been unsuccessful (S35) and terminates the action of the reception circuit section 3 to terminate the reception process (S36). The fixed-time reception control section 472 then terminates the reception control process S30.

On the other hand, when a result of the evaluation in S33 is YES, the fixed-time reception control section 472 acquires a marker representing the position of 0 seconds in the time code for frame synchronization (S37). For example, in JJY, a portion where markers carrying P0 and M are consecutively present is a start point of a time code, and the frame synchronization can be established by detection of the consecutive markers.

Having acquired the markers and established the frame synchronization, the fixed-time reception control section 472 causes the TCO decoding section 41 to decode the TCO signal outputted from the binarization circuit 37 for acquisition of the time code (TC) (S38).

The fixed-time reception control section 472 then evaluates whether or not a predetermined period (7 minutes) has elapsed since the reception started (S39).

When a result of the evaluation in S39 is YES, it is determined that no standard radio wave can be received. The fixed-time reception control section 472 therefore determines in S35 that the reception has been unsuccessful and terminates the action of the reception circuit section 3 in S36 to terminate the reception process. The fixed-time reception control section 472 then terminates the reception control process S30.

When a result of the evaluation in S39 is NO, the fixed-time reception control section 472 evaluates conformity of the time data acquired in S38 based on information on the TC itself (S40). Specifically, when the time data shows actually existing time, for example, 24 o'clock, it is determined that the conformity is verified, whereas when the time data shows actually non-existing time, for example, 25 o'clock, it is determined that the conformity is not verified.

Further, when a standard radio wave containing a parity bit, such as JJY, is received, the fixed-time reception control section 472 uses the parity bit to evaluate the conformity of time data.

When a result of the evaluation in S40 is YES, the fixed-time reception control section 472 causes the reception time data storage section 422 to store the acquired time data (S41).

At this point, the fixed-time reception control section 472 detects how many frames have elapsed since the reception process started when the time data acquired in S38 is received and causes one of the first-frame reception time data storage section 422A to the seventh-frame reception time data storage section 422G that corresponds to a result of the detection to store the acquired time data.

For example, time data received first (first-frame time data) is stored in the first-frame reception time data storage section 422A, and time data received second (second-frame time data) is stored in the second-frame reception time data storage section 422B.

When the time data received first is actually non-existing time and has therefore not been stored in the reception time data storage section 422 because a result of the evaluation in S40 shows that the conformity of the time data is not verified, but when the conformity of the time data received second is verified in S40, the time data received second is stored in the second-frame reception time data storage section 422B. In this case, no time data is stored in the first-frame reception time data storage section 422A.

After a plurality of sets of time data are stored in the reception time data storage section 422, the fixed-time reception control section 472 evaluates whether or not the conformity is verified among three sets of the time data (S42).

First, since the reception time data storage section 422 stores only one set of time data, a result of the evaluation in S42 is NO.

When a result of the evaluation in S40 is NO, or when a result of the evaluation in S42 is NO, the fixed-time reception control section 472 returns to the process in S38.

The fixed-time reception control section 472 then repeatedly carries out the processes from S38 to S42 until a result of the evaluation in S42 becomes YES or a predetermined period elapses. As a result, whenever a result of the evaluation in S40 is YES, time data is successively stored in the reception time data storage section 422 in S41.

After three sets of time data are stored in the reception time data storage section 422, the fixed-time reception control section 472 detects differences in time among the three sets of time data in S42. The fixed-time reception control section 472 then evaluates whether or not the detected differences in time among the three sets of time data coincide with the frame interval (one minute between consecutive frames).

For example, a description will be made of a case where time data sets received in the first, second, and third frames have all produced evaluation results of YES in S40 and have been stored in the reception time data storage section 422, with the first-frame time data being "2:00," the second-frame time data being "2:01," and the third-frame time data being "2:06."

In this case, the difference in time between the first-frame time data and the second-frame time data is one minute, and the conformity is therefore verified between the first-frame time data and the second-frame time data. On the other hand, the differences in time between the first-frame time data and the third-frame time data and between the second-frame time data and the third-frame time data should be two minutes and one minute, respectively, but are actually six minutes and five minutes, respectively. The conformity is therefore not verified among the first-frame time data, the second-frame time data, and the third-frame time data. A result of the evaluation in S42 therefore is NO.

Thereafter, when fourth-frame time data is received and stored in the reception time data storage section 422 after a result of the evaluation in S40 is YES, it is evaluated whether or not the conformity is verified among three sets of time data out of the four sets of first, second, third, and fourth-frame time data.

Assume now that the fourth-frame time data is "2:03." In this case, the differences in time between the first-frame time data and the fourth-frame time data and between the second-frame time data and the fourth-frame time data are three minutes and two minute, respectively, and the conformity is verified among the three sets of first, second, and fourth-frame time data. A result of the evaluation in S42 is therefore YES.

As described above, the fixed-time reception control section 472 evaluates whether or not the conformity is verified among three sets of time data whenever time data is stored in the reception time data storage section 422 until the conformity is verified.

It is noted that even after seventh-frame time data is received but the conformity described above is not verified, a result of the evaluation in S39 is YES, and the reception control process S30 is terminated.

If another electronic apparatus in the vicinity of the timepiece regularly produces noise, an error occurs in the same bits of the year, day, and time data in each frame, and the conformity may be verified among three sets of time data but the time data sets are incorrect in some cases. To avoid the situation, in the present embodiment, time data is compared with the internal time, followed by evaluation of whether or not the time data is correct, as will be described later.

When a result of the evaluation in S42 is YES, the fixed-time reception control section 472 determines that the reception has been successful (S43) and completes the reception process in S36 to complete the reception control process S30. The fixed-time reception control section 472 then proceeds to the process in S12 (FIG. 10).

The fixed-time reception control section 472 evaluates in S12 whether or not the reception has been successful.

When a result of the evaluation in S12 is NO, the central control circuit 47 does not correct (update) the internal time but terminates the entire process. The display control section 475, in a case where it stops moving the indication hands during reception of time data in order to suppress an influence of noise on the reception, typically moves the indication hands when the entire process in FIG. 10 is completed.

On the other hand, when a result of the evaluation in S12 is YES, the fixed-time reception control section 472 acquires the newest (latest) time data as first reception time data from the time data sets stored in the reception time data storage section 422 (S13).

The fixed-time reception control section 472 then compares the first reception time data acquired in S13 with the internal time stored in the internal time data storage section 421 (S14).

The fixed-time reception control section 472 then evaluates whether or not a difference in time between the first reception time data and the internal time is smaller than a preset threshold (first threshold) (S15). The first threshold is a fixed value in the present embodiment and is set, for example, at 15 seconds, which is the accuracy per month of a typical quartz timepiece.

When a result of the evaluation in S15 is YES, it is determined that the first reception time data is correct time data. The time correction section 474 then corrects (updates) the time counted by the time counter 471 by using the first reception time data (S16). The time correction section 474 then causes the reception success time data storage section 424 to store the first reception time data (S17).

The display control section 475 then corrects the time displayed on the display section 5 based on the corrected internal time (S18). The central control circuit 47 then completes the entire process.

On the other hand, when a result of the evaluation in S15 is NO, that is, when the difference in time between the first time data and the internal time is greater than or equal to the first threshold, the fixed-time reception control section 472 causes the first reception time data storage section 423 to store the acquired first reception time data (S19).

The fixed-time reception control section 472 then evaluates whether or not the internal time has reached second time (S20). The second time is set at time separated from the first time by a predetermined period, for example, set at 4 AM. That is, in consideration of a situation in which noise is produced in a reception environment at the first time, the second time is set at time separate by a period that is likely to allow the amount of noise to be lowered. When a result of the evaluation in S20 is NO, the fixed-time reception control section 472 performs the evaluation in S20 again.

When a result of the evaluation in S20 is YES, the fixed-time reception control section 472 carries out the reception control process S30 shown in FIG. 11 again.

The fixed-time reception control section 472 then evaluates whether or not the reception has been successful after carrying out the reception control process S30 (S21).

When a result of the evaluation in S21 is NO, the central control circuit 47 does not correct (update) the internal time but terminates the entire process.

On the other hand, when a result of the evaluation in S21 is YES, the fixed-time reception control section 472 acquires the newest time data as second reception time data from the time data sets stored in the reception time data storage section 422 (S22).

The fixed-time reception control section 472 then carries out a time correction process S50.

Figure 12:
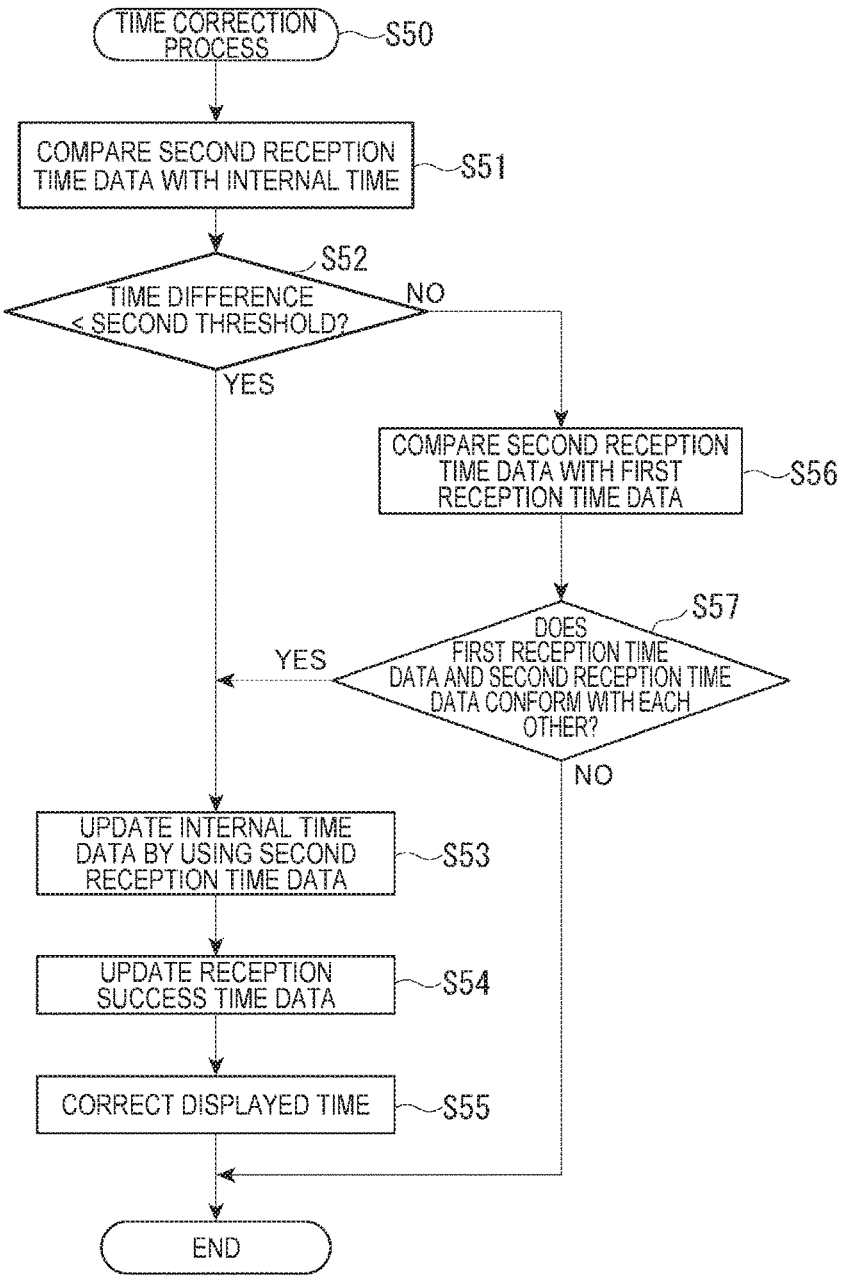
FIG. 12 is a flowchart showing a time correction process in the first embodiment.

FIG. 12 is a flowchart showing the time correction process S50.

The time correction section 474 compares the second reception time data acquired in S22 with the internal time (S51).

It is then evaluated whether or not a difference in time between the second reception time data and the internal time is smaller than a preset threshold (second threshold) (S52). The second threshold is a fixed value in the present embodiment and is set at 15 seconds, which is equal to the first threshold in the evaluation in S15.

When a result of the evaluation in S52 is YES, it is determined that the second reception time data is correct time data. The time correction section 474 then corrects (updates) the time counted by the time counter 471 by using the second reception time data (S53). The time correction section 474 then causes the reception success time data storage section 424 to store the second reception time data.

The display control section 475 then corrects the time displayed on the display section 5 based on the corrected internal time (S55). The central control circuit 47 then completes the entire process.

On the other hand, when a result of the evaluation in S52 is NO, the time correction section 474 compares the second reception time data with the first reception time data stored in the first reception time data storage section 423 (S56).

It is then evaluated whether or not the conformity between the second reception time data and the first reception time data is verified (S57).

Specifically, the time correction section 474 determines that the conformity is verified between the second reception time data and the first reception time data when the difference in time between the second reception time data and the first reception time data is equal to the difference in time between the internal time acquired when the second reception time data is received and the internal time acquired when the first reception time data is received.

When a result of the evaluation in S57 is YES, it is determined that the second reception time data is correct time data. The time correction section 474 then corrects the time counted by the time counter 471 by using the second reception time data in S53, and the time correction section 474 causes the reception success time data storage section 424 to store the second reception time data in S54. The display control section 475 then corrects the time displayed on the display section 5 based on the corrected internal time in S55. The time correction section 474 then completes the time correction process S50, and the central control circuit 47 completes the entire process.

On the other hand, when a result of the evaluation in S57 is NO, it is determined that the second reception time data is not correct time data. The time correction section 474 therefore does not update the internal time and terminates the time correction process S50, and the central control circuit 47 terminates the entire process.

FIG. 13 shows an example of the correction of the internal time.

When the first reception time data is "A1" (time that differs from internal time by a period smaller than 15 seconds), no reception process is carried out at the second time, and the internal time is corrected by using the first reception time data "A1", as in the case "1" in FIG. 13.

A description will next be made of a case where the first reception time data is "B1" (time that differs from the internal time by 15 seconds or longer) (cases "2" to "4"). In this case, the reception process is carried out at the second time.

When the second reception time data is "A2" (time that differs from the internal time by a period smaller than 15 seconds), the internal time is corrected by using the second reception time data "A2", as in the case "2".

When the second reception time data is "B2" (time that differs from the internal time by 15 seconds or longer and is verified to conform with "B1"), the internal time is corrected by using the second reception time data "B2", as in the case "3".

When the second reception time data is "B3" (time that differs from the internal time by 15 seconds or longer and is not verified to conform with "B1"), the internal time is not corrected, as in the case "4".

Manual Time Correction Action

Figure 14:
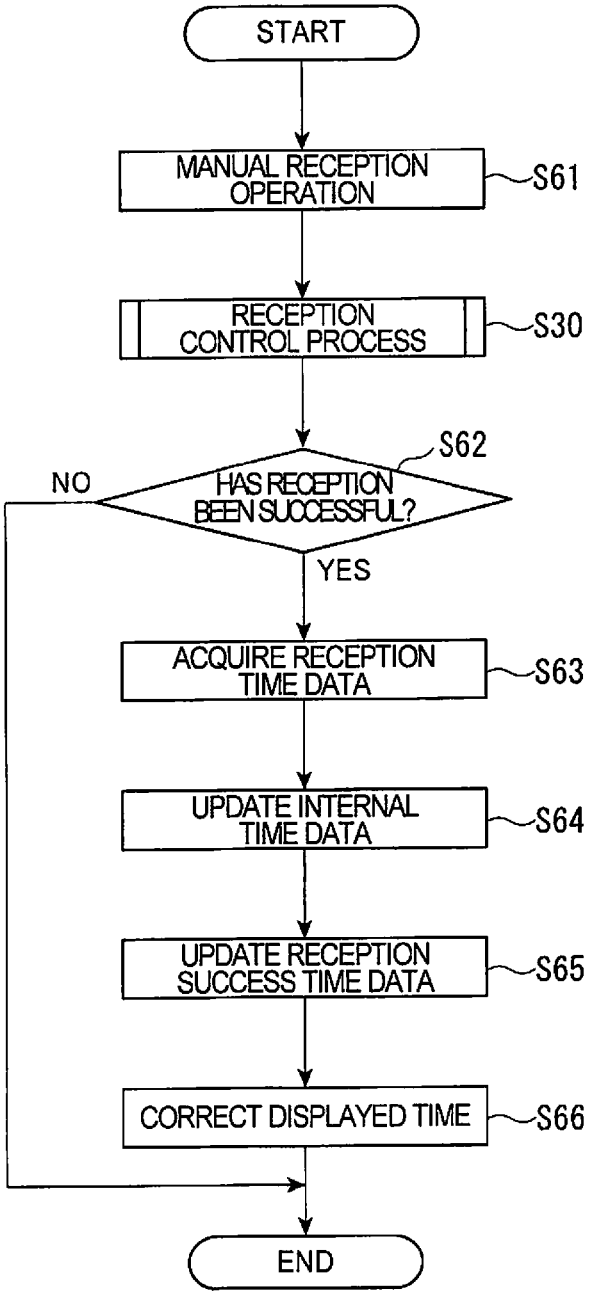
FIG. 14 is a flowchart showing manual time correction action in the first embodiment.

FIG. 14 is a flowchart showing action of manually correcting the time of the radio correction timepiece 1.

When detecting that manual reception operation has been performed on the external operation member 11 (S61), the manual reception control section 473 carries out the reception control process S30 (FIG. 11).

After the reception control process S30, the manual reception control section 473 evaluates whether or not the reception has been successful (S62).

When a result of the evaluation in S62 is NO, the central control circuit 47 does not correct (update) the internal time but terminates the entire process. The display control section 475, when it stops moving the indication hands during reception of time data in order to suppress an influence of noise on the reception, typically moves the indication hands when the entire process in FIG. 14 is completed.

On the other hand, when a result of the evaluation in S62 is YES, the time correction section 474 acquires the newest time data as reception time data from three sets of time data having been verified to conform with one another in the reception control process S30 (S63) and corrects the internal time by using the reception time data (S64). The time correction section 474 then causes the reception success time data storage section 424 to store the reception time data (S65).

The display control section 475 then corrects the time displayed on the display section 5 based on the corrected internal time (S66). The central control circuit 47 then completes the entire process.

As described above, in the manual time correction action, the central control circuit 47 does not compare reception time data acquired in the reception process with the internal time but corrects the internal time by using the reception time data.

Advantageous Effects of First Embodiment

A description will now be made of the waveform of the TCO signal affected by noise.

Figure 15:
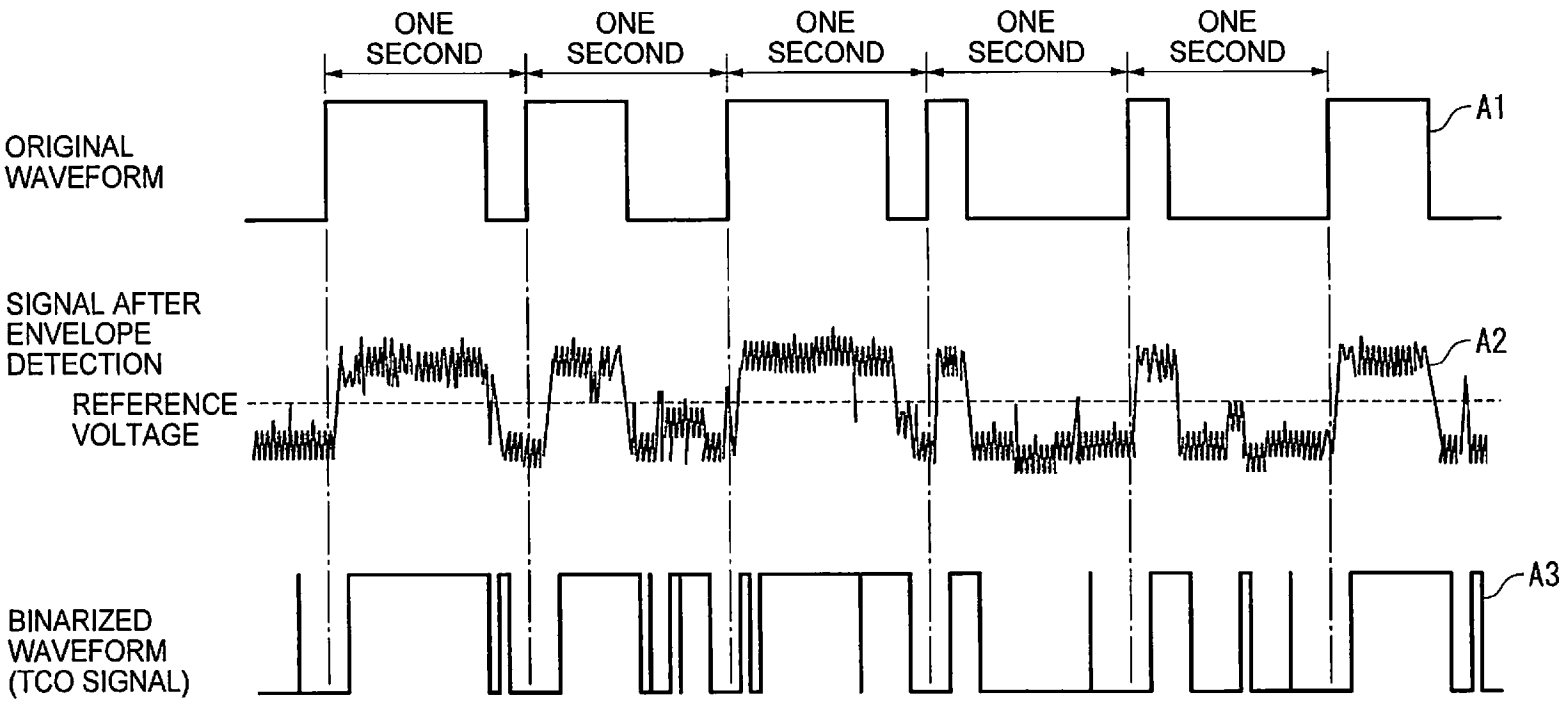
FIG. 15 describes the waveform of a TCO signal affected by noise.

The original waveform of a standard radio wave is a rectangular waveform and rises every second, as indicated by A1 in FIG. 15, for example, in JJY. The waveform of the signal from the envelope detection circuit 35 is, however, an amplified waveform of a weak signal, as indicated by A2, and is very noisy when an electronic apparatus (DC/DC converter, for example) is used in the reception environment.

In such a noisy environment, a waveform A3 of the TCO signal outputted from the binarization circuit 37 is disturbed, and the pulse rising timing also undesirably deviates from the timing in the original waveform.

Correct reception time data cannot therefore be acquired at the first time in a noisy reception environment.

However, if no electronic apparatus is used in the period from the first time to the second time and the amount of noise therefore decreases at the second time in the reception environment, the radio correction timepiece 1 can acquire correct reception time data at the second time. The possibility of accurate correction of the internal time can therefore be increased as compared with a case where reception time data is acquired only at the first time.

Further, the evaluation of whether or not reception time data is correct, which is performed by comparison of the reception time data with the internal time, can be performed even when the type of the standard radio wave is, for example, WWVB, which contains no parity bit. It is noted that when the type of the standard ratio wave is, for example, JJY, which contains parity bits, the evaluation of whether or not reception time data is correct can be more accurately performed by comparison of the reception time data with the internal time.

Further, when accurate first reception time data is acquired at the first time, the internal time is corrected by using the first reception time data and no reception process is carried out at the second time. The power consumption can therefore be lowered as compared with a case where the reception process is always carried out at the first time and the second time.

When the difference in time between the first reception time data and the internal time is greater than or equal to the first threshold and the difference in time between the second reception time data and the internal time is greater than or equal to the second threshold, it is conceivable that at least one of the first reception time data/the second reception time data and the internal time.

In this case, when the second reception time data and the first reception time data are verified to conform with each other, it is determined that the internal time is incorrect and the second reception time data and the first reception time data are correct time data. The internal time can therefore be accurately corrected by correction of the internal time based on the second reception time data.

On the other hand, when the second reception time data and the first reception time data are not verified to conform with each other, it is determined that at least one of the second reception time data and the first reception time data is incorrect, and the internal time is likely to be correct. The internal time is therefore not corrected based on the second reception time data, whereby a situation in which the internal time is corrected to incorrect time can be avoided.

Since a case where the manual reception operation is performed is a case where the user desires to correct time, it is expected that the internal time deviates from correct time. In this case, comparison of reception time data with the internal time does not allow evaluation of whether or not the reception time data is correct. In this case, the internal time is corrected based on reception time data without comparison of the reception time data with the internal time for immediate correction of the internal time.

When time data sets corresponding to a plurality of frames are received in the reception process, and the conformity of the time data is verified among three frames, the fixed-time reception control section acquires the newest time data as the first reception time data or the second reception time data. The fixed-time reception control section can therefore more precisely evaluate whether or not the first reception time data or the second reception time data is correct, whereby the internal time can be more accurately corrected.

Second Embodiment

A radio correction timepiece according to a second embodiment differs from the radio correction timepiece 1 according to the first embodiment in terms of part of the processes in the time correction action performed at preset time.

Figure 16:
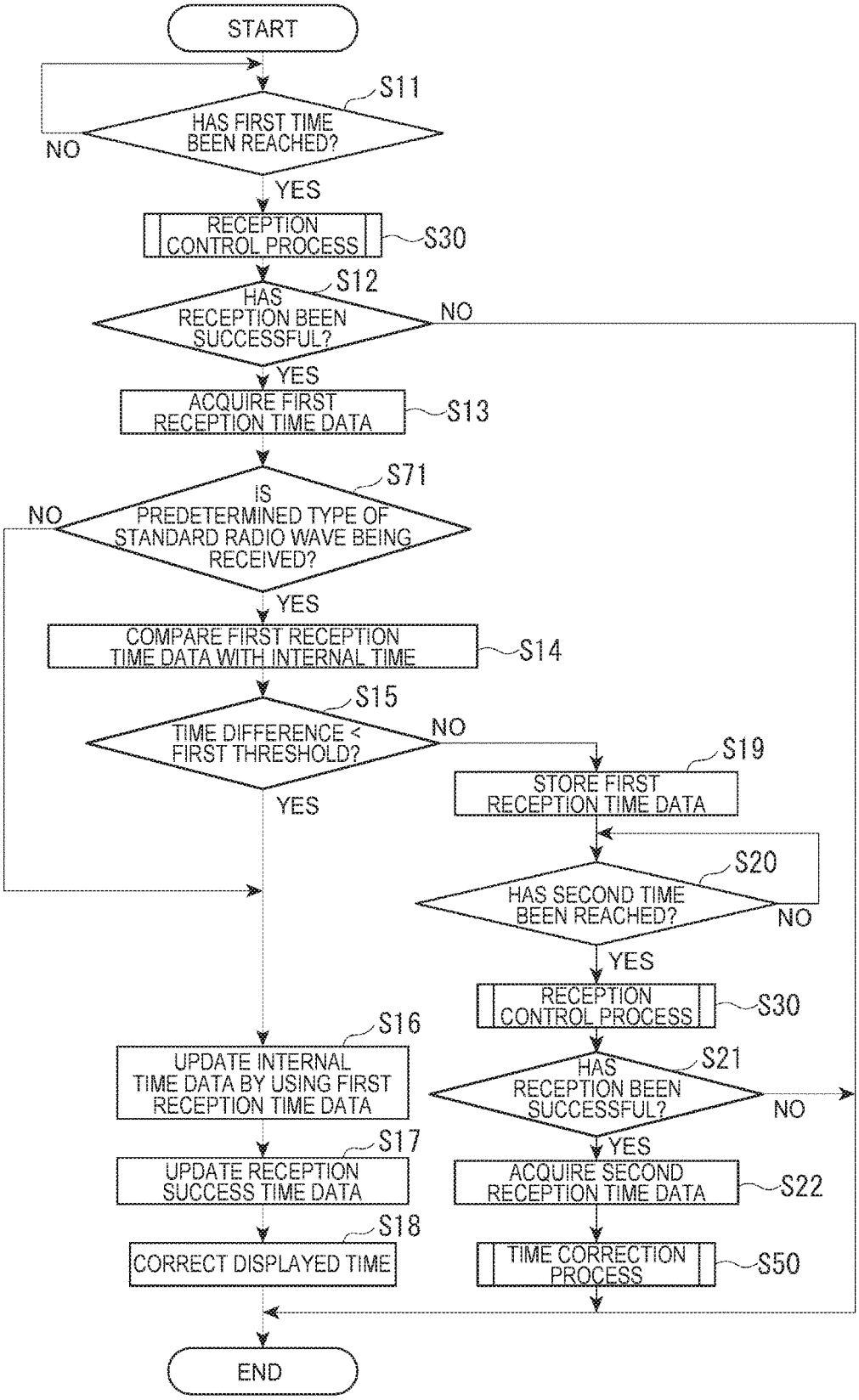
FIG. 16 is a flowchart showing fixed-time time correction action according to a second embodiment of the invention.

In the time correction action in the second embodiment, processes in S11 to S22, S30, S50, and S71 are carried out, as shown in FIG. 16. Among the processes described above, the processes in S11 to S22, S30, and S50 are the same as those in S11 to S22, S30, and S50 in the first embodiment and will therefore not be described.

In the time correction action in the second embodiment, after the first reception time data is acquired in S13, the fixed-time reception control section 472 evaluates whether or not the type of the standard radio wave being received is a predetermined type of standard radio wave (S71). The standard radio wave of the predetermined type is a standard radio wave containing no parity bit, such as WWVB. The type of the standard radio wave received by the fixed-time reception control section 472 is selected by the user through the user's setting of a reception station, as described above.

When a result of the evaluation in S71 is YES, the fixed-time reception control section 472 proceeds to the process in S14, where the first reception time data is compared with the internal time.

On the other hand, when a result of the evaluation in S71 is NO (for example, when the received standard radio wave is a standard radio wave containing a parity bit, such as JJY), in the reception control process S30 (FIG. 11), the conformity of time data with the parity bit is evaluated in S40, and the conformity among three sets of time data is evaluated in S42. The first reception time data is therefore likely to be correct time data.

That is, in WWVB, which contains no parity bit, a 1-bit data error cannot be detected in some cases, whereas in JJY, which contains parity bits, a 1-bit data error can be detected.

Therefore, when a result of the evaluation in S71 is NO, the fixed-time reception control section 472 does not compare the first reception time data with the internal time but proceeds to the process in S16. The time correction section 474 then corrects the internal time by using the first reception time data.

Advantageous Effects of Second Embodiment

The second embodiment can also provide the same advantageous effects as those of the first embodiment because the radio correction timepiece according to the second embodiment has the same configuration as that of the radio correction timepiece 1 according to the first embodiment. The second embodiment can further provide the following advantageous effects.

A standard radio wave containing no parity bit does not allow evaluation of whether or not first reception time data is correct based on information on a TC itself. Whether or not the first reception time data is correct is therefore evaluated by comparison of the first reception time data with the internal time.

On the other hand, a standard radio wave containing a parity bit allows determination of correctness of first reception time data as long as the parity bit is used to verify the conformity of the first reception time data. The internal time can therefore be immediately corrected by correction of the internal time based on the first reception time data. Further, since no reception process is carried out at the second time, the power consumption can be lowered as compared with a case where the reception process is always carried out at the first time and the second time.

Third Embodiment

A radio correction timepiece according to a third embodiment differs from the radio correction timepieces according to the first and second embodiments in terms of part of the processes in the time correction action performed at preset time.

Figure 17:
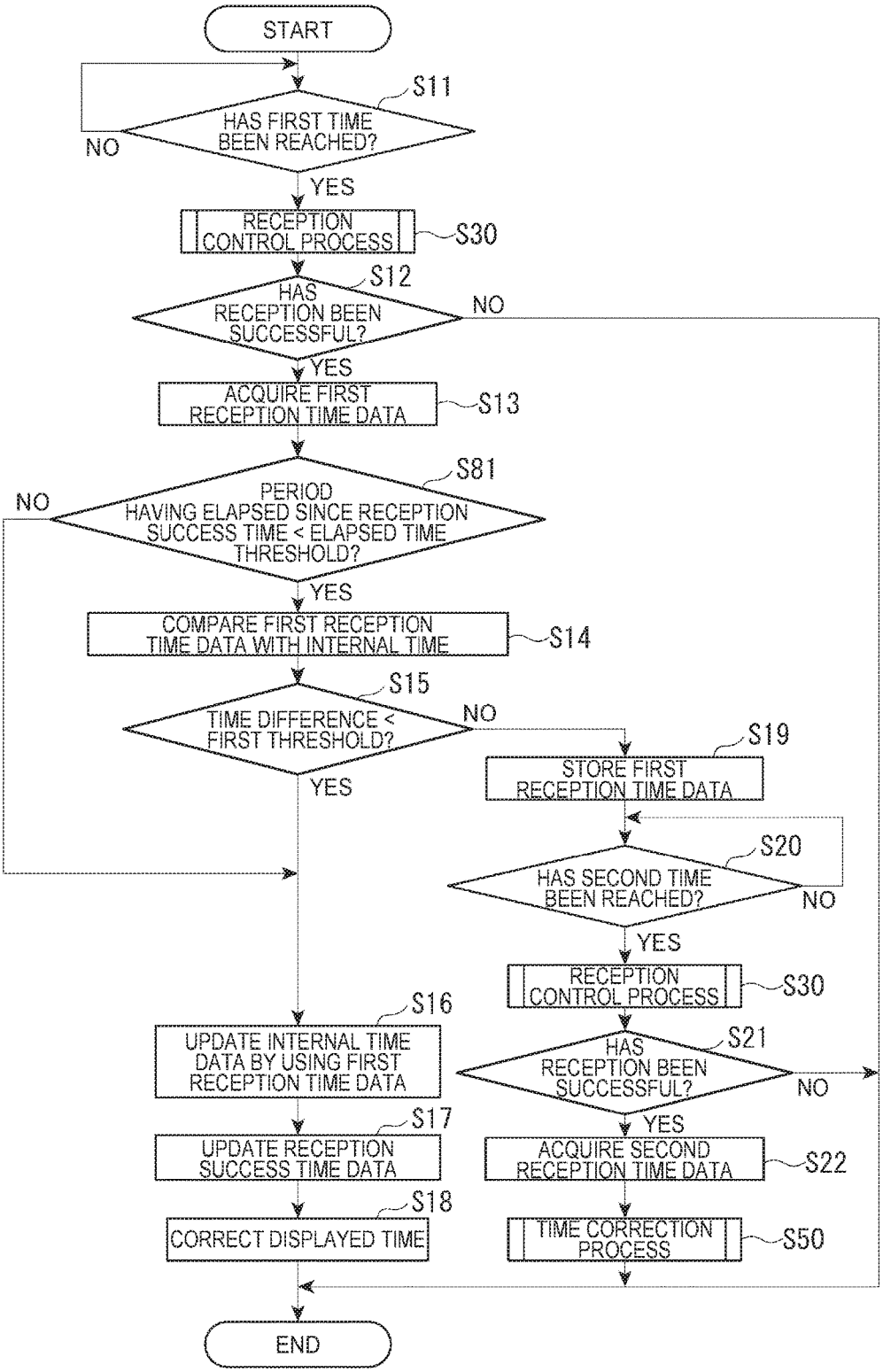
FIG. 17 is a flowchart showing fixed-time time correction action according to a third embodiment of the invention.

In the time correction action in the third embodiment, processes in S11 to S22, S30, S50, and S81 are carried out, as shown in FIG. 17. Among the processes described above, the processes in S11 to S22, S30, and S50 are the same as those in S11 to S22, S30, and S50 in the first embodiment and will therefore not be described.

In the time correction action in the third embodiment, after the first reception time data is acquired in S13, the fixed-time reception control section 472 evaluates whether or not the period having elapsed since the reception success time stored in the reception success time data storage section 424 is shorter than a preset elapsed period threshold (S81). In the present embodiment, the elapsed period threshold is set at six months.

When a result of the evaluation in S81 is YES, the fixed-time reception control section 472 proceeds to the process in S14, where the first reception time data is compared with the internal time.

On the other hand, when a result of the evaluation in S81 is NO, the fixed-time reception control section 472 does not compare the first reception time data with the internal time but proceeds to the process in S16. The time correction section 474 then corrects the internal time by using the first reception time data.

Advantageous Effects of Third Embodiment

For example, when a radio correction timepiece is left in a dark place where no electricity is generated and operates in a power-saving state, the fixed-time reception is not performed in some cases. Therefore, when the power-saving state lasts for a long period, the internal time possibly deviates from correct time by a large amount.

In this case, it cannot be evaluated whether or not first reception time data is correct even by comparison of the first reception time data with the internal time.

Therefore, when the period having elapsed since the reception success time is longer than or equal to the elapsed period threshold, the internal time can be immediately corrected by correction of the internal time based on the first reception time data. Further, since no reception process is carried out at the second time, the power consumption can be lowered as compared with a case where the reception process is always carried out at the first time and the second time.

Other Embodiments

The invention is not limited to the embodiments described above, and changes, improvement, and other modifications to the extent that they can achieve the advantage of the invention fall within the scope of the invention.

In each of the embodiments described above, each of the first and second thresholds is a fixed value, but the invention is not necessarily configured this way.

Figure 18:
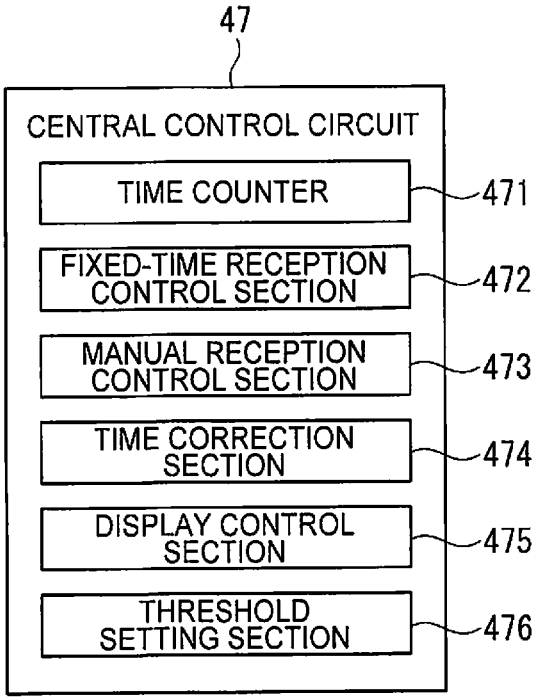
FIG. 18 shows the configuration of a central control circuit according to another embodiment of the invention.

For example, the central control circuit 47 may include a threshold setting section 476, and the threshold setting section 476 may set the first and second thresholds in accordance with the period having elapsed since the reception success time as shown in FIG. 18.

The difference in time between the internal time and correct time increases as the period having elapsed since the reception success time increases due to the precision of the quartz oscillator 431. For example, when the elapsed period is one month, the time difference is 15 seconds at the maximum, and when the elapsed period is two months, the time difference is 30 seconds at the maximum.

Therefore, when the elapsed period described above is, for example, longer than or equal to one month, the time difference from the internal time is possibly longer than or equal to 15 seconds even in the case where the first reception time data or the second reception time data is correct. Therefore, when each of the first and second thresholds is fixed at 15 seconds, the time difference described above is longer than or equal to the first and second thresholds even in the case where each reception time data is correct, and the reception time data is not determined to be correct.

In contrast, the threshold setting section 476 can be configured to increase the first and second thresholds as the elapsed period described above increases. For example, the threshold setting section 476 may initially set the first and second thresholds at 15 seconds, and then set the first and second thresholds at 30 seconds when the elapsed period described above reaches one month. The thus set first and second thresholds allow correct evaluation of whether or not each reception time data is correct even when the elapsed period described above is longer than or equal to one month.

The threshold setting section 476 may instead, for example, initially set the first and second thresholds at 5 seconds, then set the first and second thresholds at 10 seconds when the elapsed period described above reaches 10 days, and then set the first and second thresholds at 15 seconds when the elapsed period described above reaches 20 days.

Further, the first and second thresholds may differ from each other.

In each of the embodiments described above, the internal time is corrected by using first reception time data when the difference in time between the first reception time data and the internal time is smaller than the first threshold, but the invention is not necessarily configured this way. That is, for example, when the first reception time data coincides with the internal time, the internal time may not be corrected by using the first reception time data.

In each of the embodiments described above, when the difference in time between the second reception time data and the internal time is greater than or equal to the second threshold, the second reception time data is compared with the first reception time data, but the invention is not necessarily configured this way. That is, the second reception time data may not be compared with the first reception time data. In this case, the internal time is not corrected.

In each of the embodiments described above, when the reception is unsuccessful at the first time, no reception process is carried out by the first time on the following day, but the invention is not necessarily configured this way. For example, the reception process may be carried out at the second time.

In each of the embodiments described above, when the conformity of time data is verified based on information on a TC itself (when a result of the evaluation in S40 is YES and a result of the evaluation in S42 is YES), the time data is acquired as the first or second reception time data, but the invention is not necessarily configured this way. For example, without verification of the conformity of received time data, the time data may be acquired as the first or second reception time data.

In each of the embodiments described above, when time data sets corresponding to a plurality of frames are received in the reception process, and the conformity of time data among three frames is verified, the fixed-time reception control section 472 acquires the newest time data as the first or second reception time data, but the invention is not necessarily configured this way.

For example, the number of time data sets the conformity of which is verified is not limited to three and may instead be two or four or more.

Further, the reception period may be set to be longer than 7 seconds, and the number of time data frames that can be stored in the reception time data storage section 422 may be greater than 7. In this case, the probability of successful reception is increased.

In each of the embodiments described above, when the internal time cannot be corrected in the reception process at 2 AM, the fixed-time reception control section 472 carries out the reception process at 4 AM, but the invention is not necessarily configured this way. For example, the reception process may be carried out at 3 AM. Further, when the internal time cannot be corrected in the reception process at 3 AM, the reception process may further be carried out at 4 AM.

The point of time at which the reception process is carried out and the number of points of time at which the reception process is carried out can be arbitrarily set, but the reception process is preferably carried out about twice to four times or every hour to every two hours in the middle of the night, when the amount of noise is small.

In each of the embodiments described above, when the internal time is corrected by using reception time data, the reception time data is stored as reception success time in the reception success time data storage section 424. In the first and second embodiments, however, no reception time data may be stored as the success time in the reception success time data storage section 424.

The entire disclosure of Japanese Patent Application No. 2015-041995, filed Mar. 4, 2015 is expressly incorporated by reference herein.

What is claimed is:

1. A radio controlled timepiece comprising:

a reception section that receives a standard radio wave;

a reference signal source that produces a reference signal;

a time measurement section that measures internal time based on the reference signal;

a reception control section that causes the reception section to operate and carries out a reception process; and a time correction section that corrects the internal time, wherein the reception control section carries out the reception process at first time to acquire first reception time data, compares the acquired first reception time data with the internal time, and carries out the reception process at second time different from the first time to acquire second reception time data when a difference in time between the first reception time data and the internal time is greater than or equal to a preset first threshold, and the time correction section compares the acquired second reception time data with the internal time, and corrects the internal time based on the second reception time data when a difference in time between the second reception time data and the internal time is smaller than a preset second threshold.

2. The radio controlled timepiece according to claim 1, further comprising a storage section, wherein the reception control section causes the storage section to store the acquired first reception time data when the difference in time between the first reception time data and the internal time is greater than or equal to the first threshold, and the time correction section compares the second reception time data with the first reception time data stored in the storage section when the difference in time between the second reception time data and the internal time is greater than or equal to the second threshold, and corrects the internal time based on the second reception time data when conformity is verified between the second reception time data and the first reception time data.

3. The radio controlled timepiece according to claim 2, wherein the time correction section does not correct the internal time based on the second reception time data when conformity is not verified between the second reception time data and the first reception time data.

4. The radio controlled timepiece according to claim 1, wherein the reception section is configured to be capable of receiving a plurality of types of standard radio wave, and when the type of the standard radio wave received by the reception section is a predetermined type set in advance, the reception control section compares the acquired first reception time data with the internal time and carries out the reception process at the second time to acquire the second reception time data when the difference in time between the first reception time data and the internal time is greater than or equal to the first threshold, whereas when the type of the standard radio wave received by the reception section is not the predetermined type, the time correction section corrects the internal time based on the first reception time data when conformity of the acquired first reception time data is verified.

5. The radio controlled timepiece according to claim 1, further comprising:

a storage section; and a threshold setting section that sets the first threshold and the second threshold, wherein when the time correction section corrects the internal time by using reception time data acquired in the reception process carried out by the reception section that is caused to be in operation, the time correction section causes the storage section to store the reception time data as reception success time, and the threshold setting section sets the first threshold and the second threshold in accordance with a period having elapsed since the reception success time.

6. The radio controlled timepiece according to claim 1, further comprising:

a storage section, wherein when the time correction section corrects the internal time by using reception time data acquired in the reception process carried out by the reception section that is caused to be in operation, the time correction section causes the storage section to store the reception time data as reception success time, and when a period having elapsed since the reception success time is shorter than a preset elapsed time threshold, the reception control section compares the acquired first reception time data with the internal time and carries out the reception process at the second time to acquire the second reception time data in the case where the difference in time between the first reception time data and the internal time is greater than or equal to the first threshold, whereas when the period having elapsed since the reception success time is longer than or equal to the elapsed time threshold, the time correction section corrects the internal time based on the acquired first reception time data.

7. The radio controlled timepiece according to claim 1, further comprising:

an operation section; and a manual reception control section that causes the reception section to operate and carries out the reception process when manual reception operation is performed on the operation section, wherein the time correction section does not compare reception time data acquired in the reception process carried out by the manual reception control section with the internal time but corrects the internal time based on the reception time data.

8. The radio controlled timepiece according to claim 1, wherein the reception control section receives time data corresponding to a plurality of frames in the reception process at the first time and, when conformity of the time data is verified among the frames, acquires newest time data as the first reception time data, and the reception control section further receives time data corresponding to a plurality of frames in the reception process at the second time and, when conformity of the time data is verified among the frames, acquires newest time data as the second reception time data.

9. A method for controlling a radio controlled timepiece including a reference signal source that produces a reference signal and a time measurement section that measures internal time based on the reference signal, the method comprising:

carrying out a reception process of receiving a standard radio wave at first time to acquire first reception time data;

comparing the acquired first reception time data with the internal time;

carrying out the reception process of receiving the standard radio wave at second time different from the first time to acquire second reception time data when a difference in time between the first reception time data and the internal time is greater than or equal to a preset first threshold;

comparing the acquired second reception time data with the internal time; and correcting the internal time based on the second reception time data when a difference in time between the second reception time data and the internal time is smaller than a preset second threshold.

* * * * *